US009205298B2

(12) United States Patent
Hockridge et al.

(10) Patent No.: US 9,205,298 B2
(45) Date of Patent: Dec. 8, 2015

(54) EXERCISE MACHINE WITH UNSTABLE USER SUPPORT

(75) Inventors: Bruce Hockridge, San Diego, CA (US); Jeffrey O. Meredith, San Diego, CA (US); Thao V. Doan, San Diego, CA (US)

(73) Assignee: Hoist Fitness Systems, Inc., Poway, CA (US)

( * ) Notice: Subject to any disclaimer, the term of this patent is extended or adjusted under 35 U.S.C. 154(b) by 250 days.

(21) Appl. No.: 13/491,256

(22) Filed: Jun. 7, 2012

(65) Prior Publication Data

US 2013/0274079 A1 Oct. 17, 2013

Related U.S. Application Data

(60) Provisional application No. 61/625,228, filed on Apr. 17, 2012.

(51) Int. Cl.
*A63B 21/062* (2006.01)
*A63B 26/00* (2006.01)
(Continued)

(52) U.S. Cl.
CPC ..... *A63B 22/14* (2013.01); *A63B 22/16* (2013.01); *A63B 23/12* (2013.01); *A63B 26/003* (2013.01); *A63B 2208/0214* (2013.01); *A63B 2208/0233* (2013.01)

(58) Field of Classification Search
CPC ..... A63B 23/02; A63B 22/16; A63B 22/14; A63B 21/062; A63B 21/1496; A63B 2021/0623; A63B 23/0211; A63B 23/0222; A63B 2208/0214; A63B 21/00065; A63B 21/00069; A63B 21/00087; A63B 21/0009; A63B 21/00094; A63B 21/00109; A63B 21/0012; A63B 21/00123; A63B 21/00127; A63B 21/1457; A63B 21/1461; A63B 21/1465; A63B 21/1476; A63B 21/1488; A63B 21/1492; A63B 22/18; A63B 23/0205; A63B 23/0216; A63B 23/0227; A63B 23/035; A63B 23/03516; A63B 23/03525; A63B 23/03575; A63B 23/04; A63B 23/0405; A63B 23/0482; A63B 23/0494; A63B 23/12; A63B 23/1209; A63B 23/1245; A63B 23/1281; A63B 2023/003; A63B 2023/006; A63B 26/00; A63B 26/003; A63B 2208/02
USPC ..... 482/142, 92–94, 98–103, 133–139
See application file for complete search history.

(56) References Cited

U.S. PATENT DOCUMENTS 3,207,464 A 9/1965 Hrach
3,367,613 A 2/1968 Christensen
(Continued)

FOREIGN PATENT DOCUMENTS

DE 20317170 U1 3/2004
GB 2 341 331 A 3/2000
JP 2010-284236 A 12/2010

OTHER PUBLICATIONS

03008 Abdominal Machine, Gym 80 Brochure, date unknown, admitted as prior art for this application, 1 page.
(Continued)

*Primary Examiner* — Oren Ginsberg
*Assistant Examiner* — Gary D Urbiel Goldner
(74) *Attorney, Agent, or Firm* — Jones Day

(57) ABSTRACT

An unstable user support device designed for mounting on a rotary torso exercise machine has a base or mounting bracket and an unstable user support platform configured for engagement by the user and pivotally mounted on the base for pivotal movement through a limited angular range about a non-vertical pivot axis. The pivoting movement may be a side to side tilting movement. Stops between the base and the unstable user support platform control the amount of pivoting movement. This arrangement provides a degree of instability to the platform, to provide a greater challenge to the user's core muscles in balancing the platform while performing an exercise motion.

34 Claims, 22 Drawing Sheets

(51) Int. Cl.

| | |
|---|---|
| ***A63B 22/14*** | (2006.01) |
| ***A63B 22/16*** | (2006.01) |
| ***A63B 23/12*** | (2006.01) |

(56) References Cited

U.S. PATENT DOCUMENTS

| | | | | |
|---|---|---|---|---|
| 3,999,702 | A | 12/1976 | Conroy | |
| 4,349,191 | A * | 9/1982 | Lambert et al. | 482/100 |
| 4,349,193 | A * | 9/1982 | Lambert et al. | 482/100 |
| 4,387,893 | A | 6/1983 | Baldwin | |
| 4,456,245 | A | 6/1984 | Baldwin | |
| 4,623,144 | A | 11/1986 | Rockwell | |
| 4,627,619 | A | 12/1986 | Rockwell et al. | |
| 4,729,562 | A | 3/1988 | Pipasik | |
| 4,836,536 | A | 6/1989 | Jones | |
| 5,007,675 | A | 4/1991 | Musto et al. | |
| 5,052,684 | A | 10/1991 | Kosuge et al. | |
| 5,056,779 | A | 10/1991 | Webb | |
| 5,094,449 | A | 3/1992 | Stearns | |
| 5,167,364 | A | 12/1992 | Wenning | |
| 5,284,461 | A | 2/1994 | Wilkinson et al. | |
| 5,346,447 | A | 9/1994 | Stearns | |
| 5,360,383 | A | 11/1994 | Boren | |
| 5,577,987 | A | 11/1996 | Brown | |
| 5,665,041 | A | 9/1997 | Hsieh | |
| 5,669,865 | A | 9/1997 | Gordon | |
| 5,681,250 | A | 10/1997 | Hoover et al. | |
| 5,692,997 | A | 12/1997 | Stearns | |
| 5,702,332 | A | 12/1997 | Hsieh | |
| 5,749,813 | A | 5/1998 | Domzalski | |
| D408,875 | S | 4/1999 | Anderson | |
| 5,902,220 | A | 5/1999 | Lin | |
| 5,938,575 | A | 8/1999 | Stearns | |
| 6,003,944 | A | 12/1999 | Glockl | |
| 6,015,370 | A | 1/2000 | Pandozy | |
| 6,168,557 | B1 | 1/2001 | Liao | |
| 6,186,926 | B1 | 2/2001 | Ellis | |
| 6,248,047 | B1 | 6/2001 | Abdo | |
| 6,379,289 | B1 | 4/2002 | Gossie | |
| 6,468,191 | B1 | 10/2002 | Cameron | |
| 6,475,120 | B2 | 11/2002 | Johnston | |
| 6,475,123 | B1 | 11/2002 | Evans | |
| 6,478,721 | B1 | 11/2002 | Hunter | |
| 6,491,611 | B1 | 12/2002 | Stearns | |
| RE38,057 | E | 4/2003 | Pandozy | |
| 6,544,154 | B2 | 4/2003 | Forcillo | |
| 6,575,884 | B1 | 6/2003 | Eazor | |
| 6,676,573 | B2 | 1/2004 | Abelbeck et al. | |
| 6,752,748 | B1 | 6/2004 | Scotti | |
| 6,966,872 | B2 | 11/2005 | Eschenbach | |
| D513,293 | S | 12/2005 | Panatta | |
| D520,084 | S | 5/2006 | McVay et al. | |
| 7,090,628 | B2 | 8/2006 | Badarneh | |
| 7,115,081 | B2 | 10/2006 | Stearns | |
| 7,150,702 | B2 | 12/2006 | Webb et al. | |
| 7,220,221 | B2 | 5/2007 | Mosimann et al. | |
| 7,438,675 | B2 * | 10/2008 | Lin | 482/140 |
| 7,494,181 | B2 | 2/2009 | Tucker | |
| 7,621,860 | B2 | 11/2009 | Burrell | |
| 7,717,832 | B2 | 5/2010 | Webber et al. | |
| 7,760,269 | B2 | 7/2010 | Ochs et al. | |
| 7,766,802 | B2 | 8/2010 | Webber et al. | |
| 7,794,371 | B2 | 9/2010 | Webber et al. | |
| 7,867,149 | B1 | 1/2011 | Webber et al. | |
| 7,901,337 | B2 | 3/2011 | Webber et al. | |
| 7,938,760 | B1 | 5/2011 | Webber et al. | |
| 7,976,440 | B2 | 7/2011 | Webber et al. | |
| 7,981,010 | B1 | 7/2011 | Webber et al. | |
| 7,993,251 | B1 | 8/2011 | Webber et al. | |
| 8,172,732 | B1 | 5/2012 | Webber et al. | |
| 8,721,510 | B2 * | 5/2014 | Chung-Ting et al. | 482/140 |
| 8,727,956 | B2 * | 5/2014 | Ho | 482/142 |
| 8,944,977 | B2 * | 2/2015 | Foster et al. | 482/137 |
| 2004/0204298 | A1 | 10/2004 | Chen | |
| 2005/0101460 | A1 * | 5/2005 | Lobban | 482/140 |
| 2005/0168017 | A1 | 8/2005 | Pernicka et al. | |
| 2006/0166799 | A1 | 7/2006 | Boland et al. | |
| 2006/0211549 | A1 | 9/2006 | Nohejl | |
| 2007/0179022 | A1 * | 8/2007 | Chen | 482/51 |
| 2007/0213187 | A1 | 9/2007 | Morgan | |
| 2007/0270295 | A1 * | 11/2007 | Balis | 482/142 |
| 2008/0085822 | A1 | 4/2008 | Webb et al. | |
| 2010/0105533 | A1 * | 4/2010 | Nohejl | 482/140 |
| 2010/0190623 | A1 * | 7/2010 | Guissin et al. | 482/142 |
| 2011/0190104 | A1 * | 8/2011 | Derrick | 482/142 |
| 2012/0115694 | A1 * | 5/2012 | Chen | 482/142 |
| 2012/0115695 | A1 * | 5/2012 | Watterson et al. | 482/142 |
| 2012/0238419 | A1 * | 9/2012 | Ho | 482/131 |
| 2013/0109551 | A1 * | 5/2013 | Ho | 482/142 |

OTHER PUBLICATIONS

07008 Abdominal Machine, Gym 80 Brochure, 2001, 2 page.

08005 Abdominal Multi-Joint Machine, Gym 80 Brochure, 2001, 1 page.

712 Abdominal isolator, Icarian Brochure, date unknown, admitted as prior art for this application, 1 page.

Ab Coaster, Advertisement, date unknown, admitted as prior art for this application, 1 page.

AB Doer Extreme, web page, http://www.asseenontv.com/prod-pages/ab.sub.-- doer.sub.--xtrm.html?gid=, printed Jun. 25, 2008, earliest date unknown, 2 pages.

AB Lounge, web page, http://ecx.images-amazon.com/images/I/4165nz401SI.SS500, printed Jun. 25, 2008, earliest date unknown, 1 page.

AB Rocket Abdominal Trainer, Amazon.com, http://www.amazon.com/gp/product/images/B000SALE1Q/ref=dp.sub.--otherview-s.sub.--3?ie=UTF, printed Jun. 25, 2008, earliest date unknown, 3 pages.

AB Zone, web page, http://www.asseenontv.com/prod-pages/abzne.sub.--ontv.html, printed Jun. 25, 2008, earliest date unknown, 1 page.

Abcore, Abcore Fitness 2005, web page, http://www.fitnessabcore.com/photos.htm#, printed Jan. 5, 2006, earliest date known, 1 page.

Body Flex Clark Bartram's 3D Abs, web page, http://www.amazon.com/gp/product/images/B0007U9CRU/ref=dp.sub.-otherview-s.sub.--1?ie=UTF, printed Jun. 25, 2008, earliest date unknown, 5 pages.

Cybex Ab Crunch, Cybex Brochure 2001, 1 page.

F-609 Abdominal Machine and F-611 Ab Flexor, Flex Brochure 1995, 1 page.

Hoist HS1350 Rotary Torso and HS1310 Ab Crunch, Hoist Fitness Systems Brochure, 2005, 8 pages.

Multi-Hinge Ab Crunch, Amazon.com, http://www.ecx.images-amazon.com/images/I/31MoMOIJHbL.sub.--SS500.jpg, printed Jun. 25, 2008, earliest date unknown, 1 page.

Posi-trak Work-Out Bench, Positrak Brochure, date unknown. cited by other . Abdominal Machine, Nautilus Brochure, 1997, 1 page.

Power Crunch, Quantum Brochure, 2004, 1 page.

Red Seat, web page, http://ecx.images-amazon.com/imagesl/41FAV4zctWI.SS500.jpg, printed Jun. 25, 2008, earliest date unknown, 1 page.

Star Trac Instinct Rotary Torso, Source 1 Medical, http://web.archive.org/20101102183507/http://www.source1.medical.com/Star-Trac-Instinct-Rotary-Torso, Nov. 2001, 2 pages.

Extended European Search Report dated Jan. 8, 2014 for related EP Patent Application No. EP 13179426.5 in 6 pages.

Partial European Search Report for related EP Application No. 13150819.4, mailed on Jul. 24, 2013, in 5 pages.

07008 Abdominal Machine, Gym 80 Brochure, 2001, 2 pages.

Ab Coaster, Advertisement, date unknown, admitted as prior art for this application, 2 pages.

AB Doer Extreme, web page, http://www.asseenontv.com/prod-pages/ab.sub.--doer.sub.--xtrm.html?gid=, printed Jun. 25, 2008, earliest date unknown, 1 page.

AB Lounge, web page, http://ecx.images-amazon.com/images/I/4165nz401Sl.SS500, printed Jun. 25, 2008, earliest date unknown, 1 page.

(56) References Cited

OTHER PUBLICATIONS

AB Rocket Abdominal Trainer, Amazon.com, http://www.amazon.com/gp/product/images/B000SALE1Q/ref=dp.sub.--otherview-s.sub.--3?ie=UTF, printed Jun. 25, 2008, earliest date unknown, 3 pages.
Body Flex Clark Bartram's 3D Abs, web page, http://www.amazon.com/gp/product/images/B0007U9CRU/ref=dp.sub.--otherview-s.sub.--1?ie=UTF, printed Jun. 25, 2008, earliest date unknown, 4 pages.
Hoist HS1350 Rotary Torso and HS1310 Ab Crunch, Hoist Fitness Systems Brochure, 2005, 1 page.
Multi-Hinge Ab Crunch, Amazon.com, http://www.ecx.images-amazon.com/images/I/31MoMOIJHbLsub.--SS500.jpg, printed Jun. 25, 2008, earliest date unknown, 1 page.
Posi-trak Work-Out Bench, Positrak Brochure, date unknown. Cited by other, 1 page.
Abdominal Machine, Nautilus Brochure, 1997, 1 page.
Power Crunch, Quantum Brochure, 2004, 2 pages.
Star Trac Instinct Rotary Torso, Source 1 Medical, http://web.archive.org/20101102183507/http://www.source1.medical.com/Star-Trac-Instinct-Rotary-Torso, Nov. 2001, 3 pages.
Hoist S602 Rotary Torso, Hoist Customer Catalog, Sep. 1997, 6 pages.
Swedish Abdominal Twister Model 3660, date unknown, admitted as prior art for this application, 1 page.
Extended European Search Report dated Oct. 8, 2013 for related EP Patent Application No. 13150819.4 in 11 pages.

* cited by examiner

EXERCISE MACHINE WITH UNSTABLE USER SUPPORT

RELATED APPLICATION

The present application claims the benefit of U.S. provisional patent application No. 61/625,228 filed Apr. 17, 2012, which is incorporated herein by reference in its entirety.

BACKGROUND

1. Field of the Invention

This invention relates generally to exercise machines and is particularly concerned with an unstable user support for an exercise machine which is designed to involve additional core muscles in holding the support steady while exercising.

2. Related Art

User supports which support an exerciser in seated, prone, kneeling, or upright positions while performing an exercise on an exercise machine are known. Such supports may be stationary, or may be designed to rock during an exercise. In a rotary torso exercise machine, a user support is mounted for rotation about a vertical axis and the user rotates their lower torso relative to their upper torso to the right and left of a central position.

SUMMARY

In one aspect, an unstable user support for supporting a user in a seated or kneeling position while performing an exercise on an exercise machine is provided, which comprises a base, a user support platform pivotally mounted on the base for side to side pivoting motion about a pivot axis beneath the user support platform, and a pair of bumper pads on the base on opposite sides of the pivot axis for engaging the user support pad to limit rotation of the user support pad in each direction to a predetermined angular range. In one embodiment, the angular range may be around 5 degrees from the horizontal orientation.

The user support platform may be designed for supporting a user in a seated position in one embodiment, or a kneeling position in another embodiment. In one embodiment, the unstable user support is designed for supporting a user in a kneeling position, and may be provided on a rotary torso exercise machine. The rotary torso machine in one embodiment comprises a main frame, a user lower torso support rotatably mounted on the frame for rotation about a first, vertical axis, and an upper torso support mounted on the frame for supporting the upper torso in a fixed position while the lower torso is rotated. The lower torso support is an unstable user support and is also pivotally mounted for limited rotation about a horizontal pivot axis so that the user has to balance the support while performing the rotating or twisting exercise motion. This produces a greater engagement of the user's core muscles in maintaining the user support in a horizontal plane while rotating their lower torso about a central vertical axis.

In another embodiment, an unstable user support may be provided on any one of a plurality of different upper torso machines to support a user in a seated position while performing an upper torso exercise, so the user employs core muscles to hold the seat level while exercising selected upper torso muscles. The unstable user support may be provided on an arm exercise machine, a shoulder press exercise machine, a chest exercise machine, a pec fly exercise machine, or a seated mid row exercise machine, or other types of exercise machines in which the user is supported in a seated or kneeling position. Unstable user supports may also be designed in a similar way for supporting users in other exercise positions in other alternative embodiments, such as prone or standing positions.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for an unstable user support device which is tiltable to the left and right through a predetermined angle so that the user must exercise core muscles in order to keep the user support pad balanced in a horizontal orientation. In one embodiment, the user support device is incorporated in a rotary torso exercise machine for supporting the user while they rotate their lower torso relative to their upper torso is rotatable about a vertical pivot axis, with the user support having a limited rotation about a horizontal pivot axis to produce a predetermined amount of instability in the platform so that the user has to engage core muscles to a greater extent in order to maintain the platform in a level position while rotating the lower torso. In one embodiment, the user support device has a kneeling platform or support pad configured for engagement by the user in an upright kneeling position. In alternative embodiments, the user support device is designed for supporting a user in a seated position and may be incorporated on other types of exercise machines.

After reading this description it will become apparent to one skilled in the art how to implement the invention in various alternative embodiments and alternative applications. However, although various embodiments of the present invention will be described herein, it is understood that these embodiments are presented by way of example only, and not limitation.

FIGS. 1 to 7 illustrate a first embodiment of an unstable user support device 10 for incorporation on a selected exercise machine, such as the rotary torso exercise machine 40 illustrated in FIGS. 8 to 16. The user support device 10 is designed to support a user in a kneeling position, but it should be understood that the device may alternatively be designed for supporting users in different positions, such as seated positions, for example as shown in the second embodiment of an unstable user support device described below in connection with FIGS. 17 to 21. The kneeling user support device 10 may also be incorporated on other exercise machines in which a user performs the exercise in a kneeling position.

Figure 1:
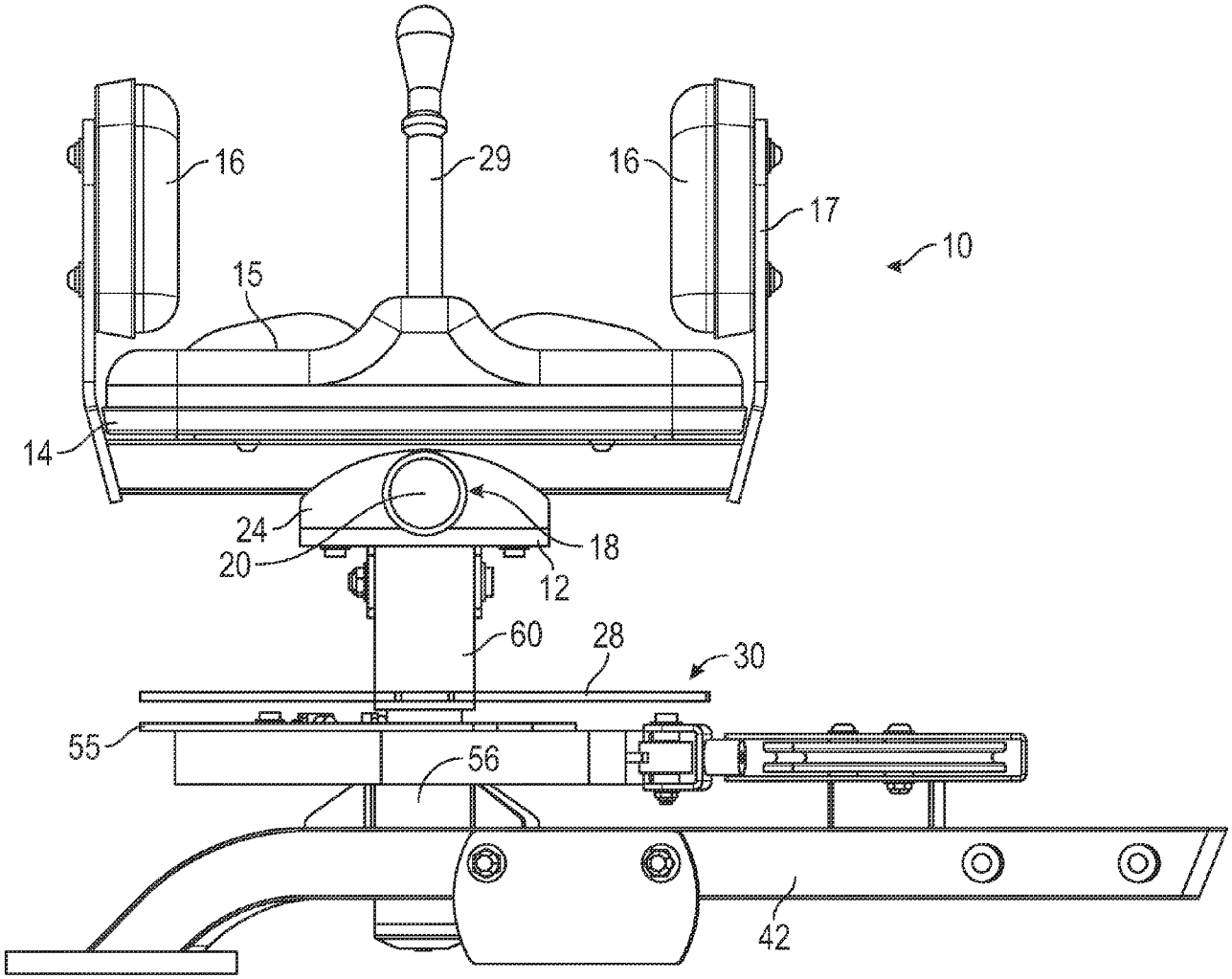
FIG. 1 is a front elevation view of an unstable user support device according to a first embodiment for supporting a user in a kneeling position.
Figure 2:
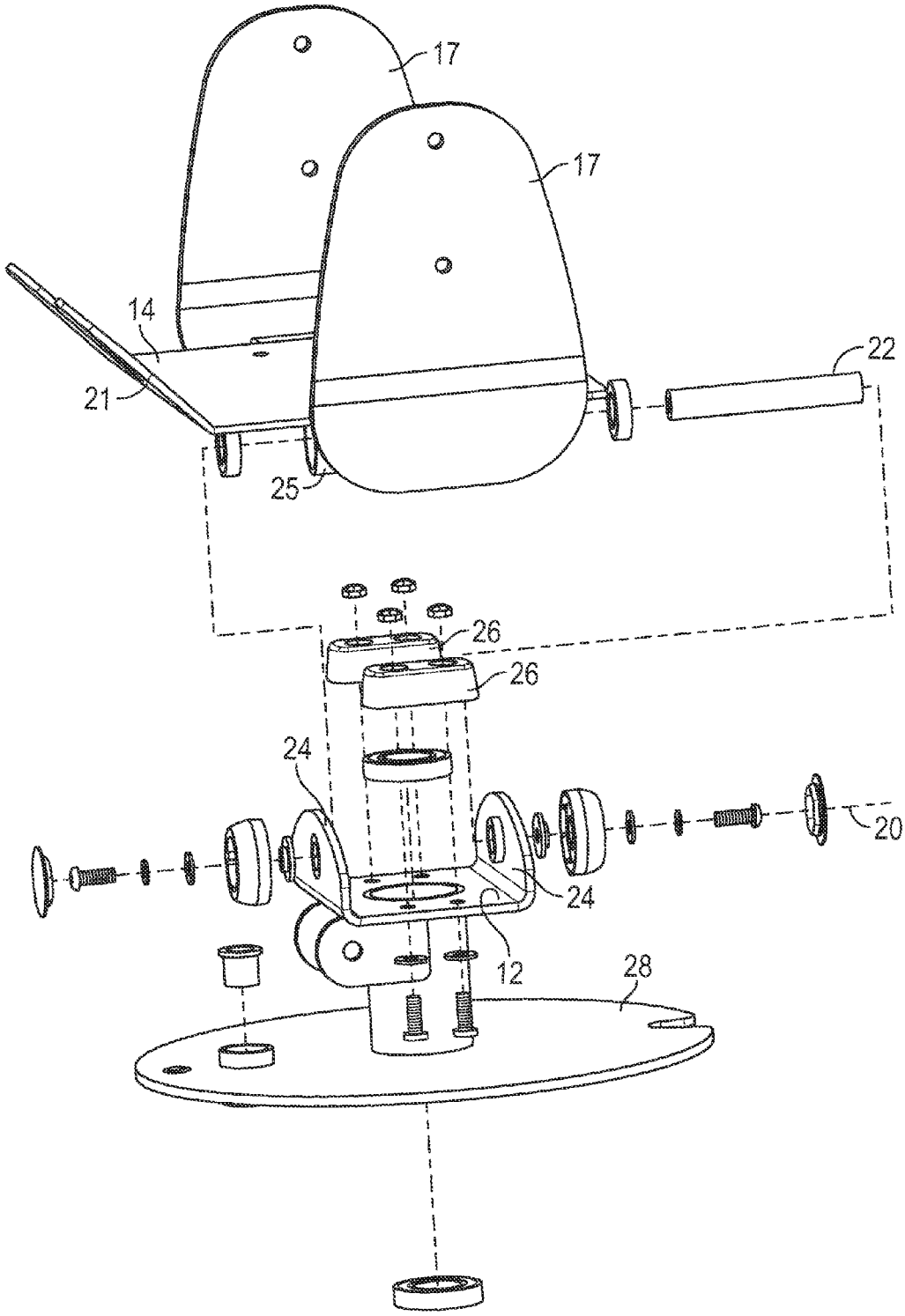
FIG. 2 is an exploded view of the components of the unstable user support device of FIG. 1.
Figure 3:
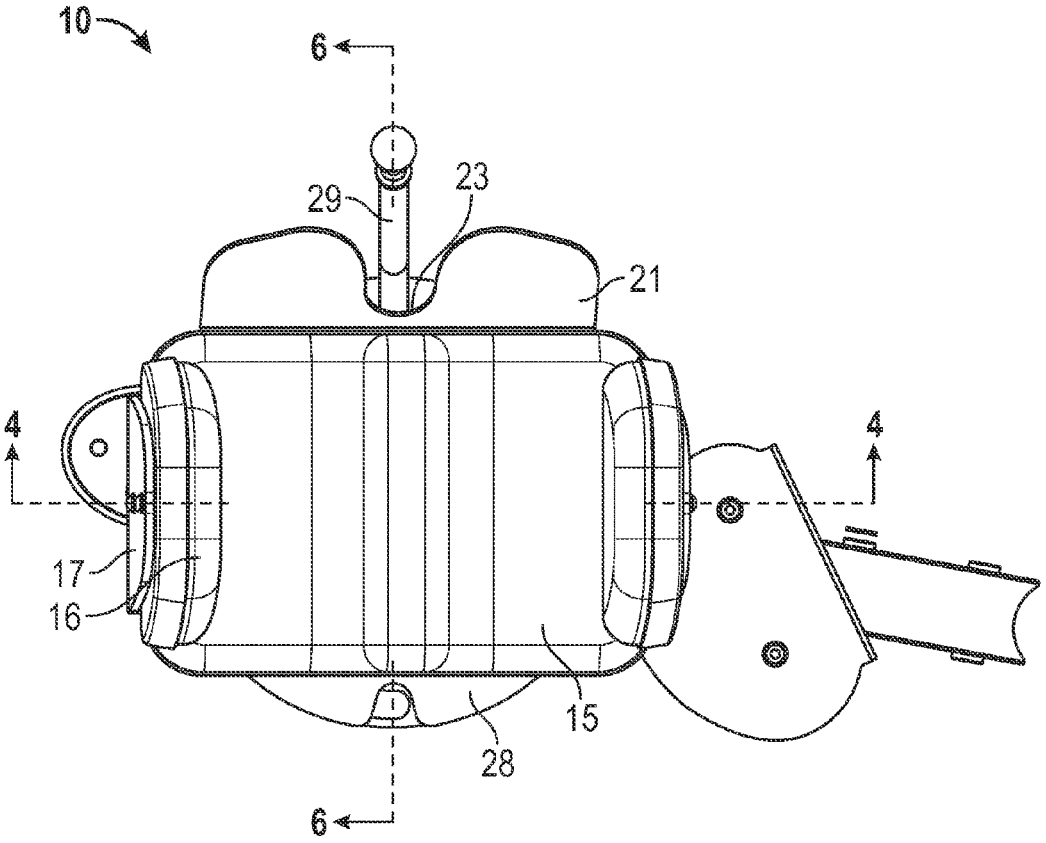
FIG. 3 is a top plan view of the unstable user support device of FIG. 1.
Figure 4:
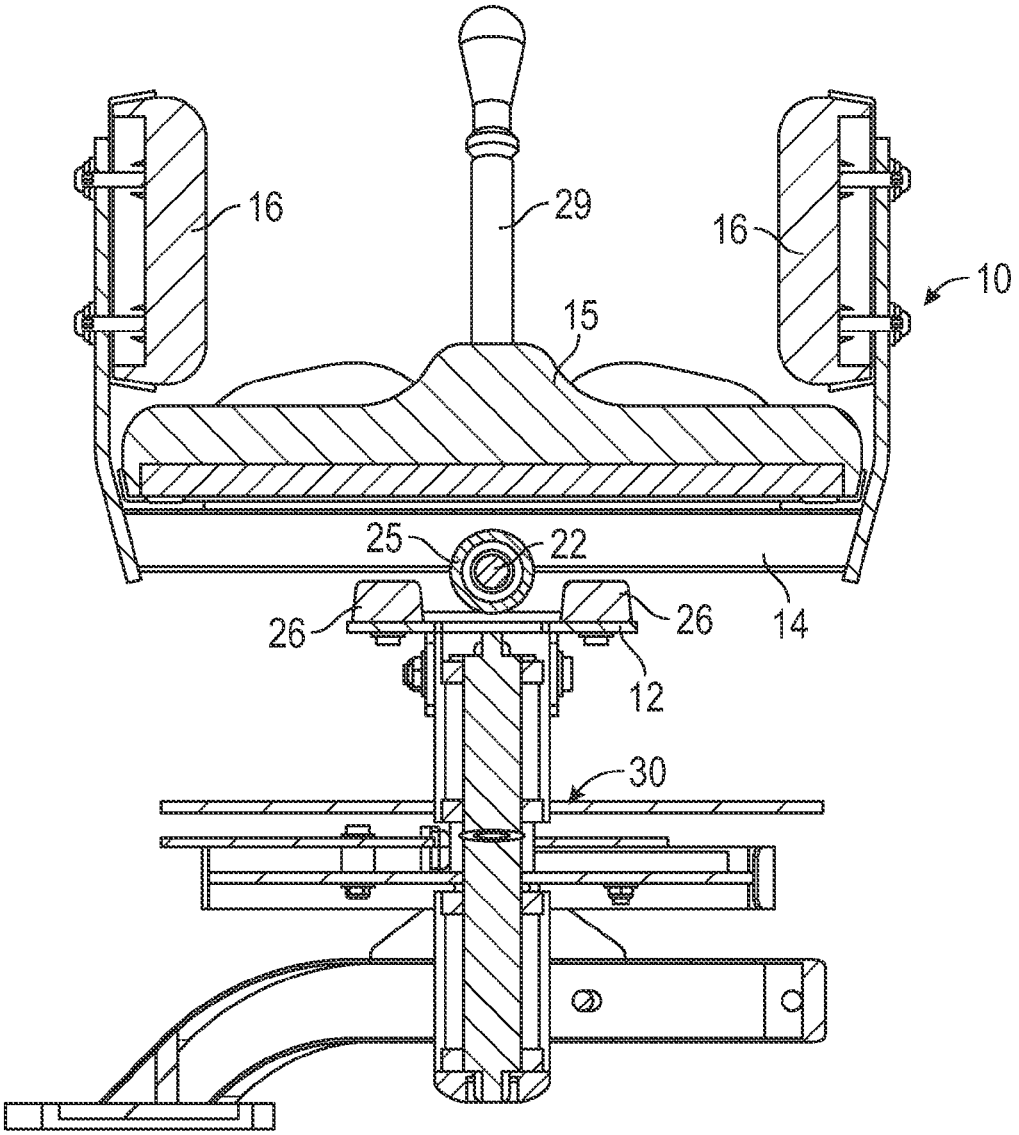
FIG. 4 is a cross-sectional view of the support device on the lines 4-4 of FIG. 3, with the user support pad in a balanced position.
Figure 10:
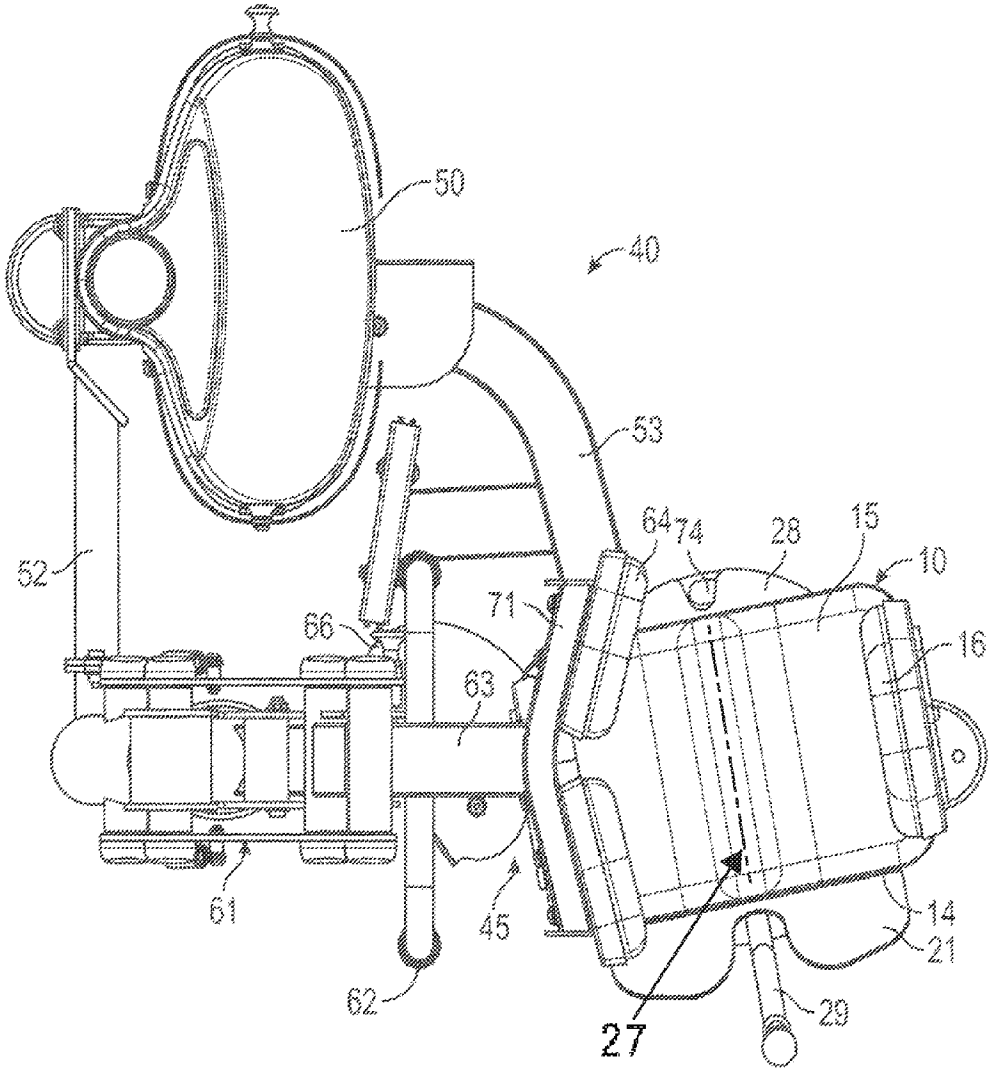
FIG. 10 is a top plan view of the rotary torso exercise machine of FIGS. 8 and 9.

As illustrated in FIGS. 1 to 7, unstable user support device 10 basically comprises a base support or mounting bracket 12, a user support platform 14 on which a kneeling pad 15 and side support pads 16 are mounted, and a pivot connection 18 between user support platform 14 and generally U-shaped base mounting bracket 12 which rotatably secures platform 14 to mounting bracket 12 for rotation about horizontal pivot axis 20 beneath platform 14 which is aligned with the direction of the user's knees when kneeling on the user support and parallel to the plane of platform 14. The user support pad 15 defines a central axis 27, as shown in FIG. 10. Side support pads 16 are secured to the inner faces of respective side portions 17 of user support platform 14, as best illustrated in FIGS. 1 and 4. As best illustrated in FIGS. 2 and 4, the pivot connection 18 comprises a pivot pin 22 secured between end plates or portions 24 of mounting bracket 12 and rotatably engaged in pivot sleeve 25 secured to the lower surface of user support platform 14. A pair of bumper pads 26 which may be of rubber or the like are secured to the base of mounting bracket 12 on opposite sides of the pivot axis, as best illustrated in FIGS. 2 and 3.

Mounting bracket 12 is designed for mounting on a user support mounting post or other mounting device on an exercise machine, in place of a conventional, stable user support, such as the user support of a rotary torso machine or any other exercise machine designed for users to perform exercises in a kneeling position. In the illustrated embodiment, mounting bracket 12 is secured to the upper rotating portion or turntable 28 of a user support rotational pivot 30 assembly via mounting post 60. Pivot assembly 30 is described in more detail below in connection with FIGS. 8 to 16. An angled guide 21 with a notch 23 for receiving a rotational range adjust lever 29 of the user support rotational pivot 30 projects from the forward end of user support platform 14, as illustrated in FIGS. 2 and 3, but guide 21 may be eliminated in alternative embodiments of the unstable user support.

Figure 5:
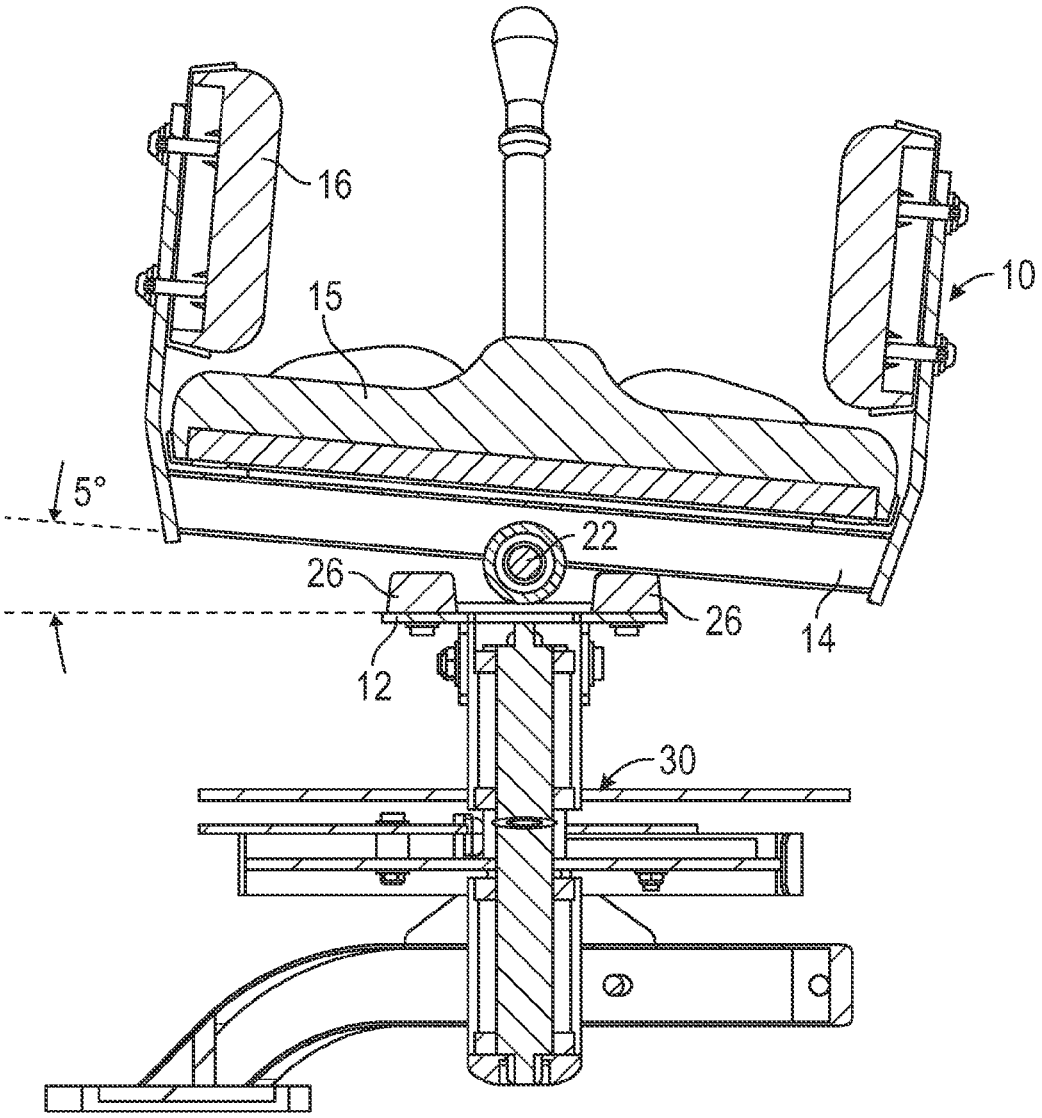
FIG. 5 is a cross-sectional view similar to FIG. 3 but illustrating the user support pad tilted down on one side and contacting the rubber bumper pad or stop.
Figure 6:
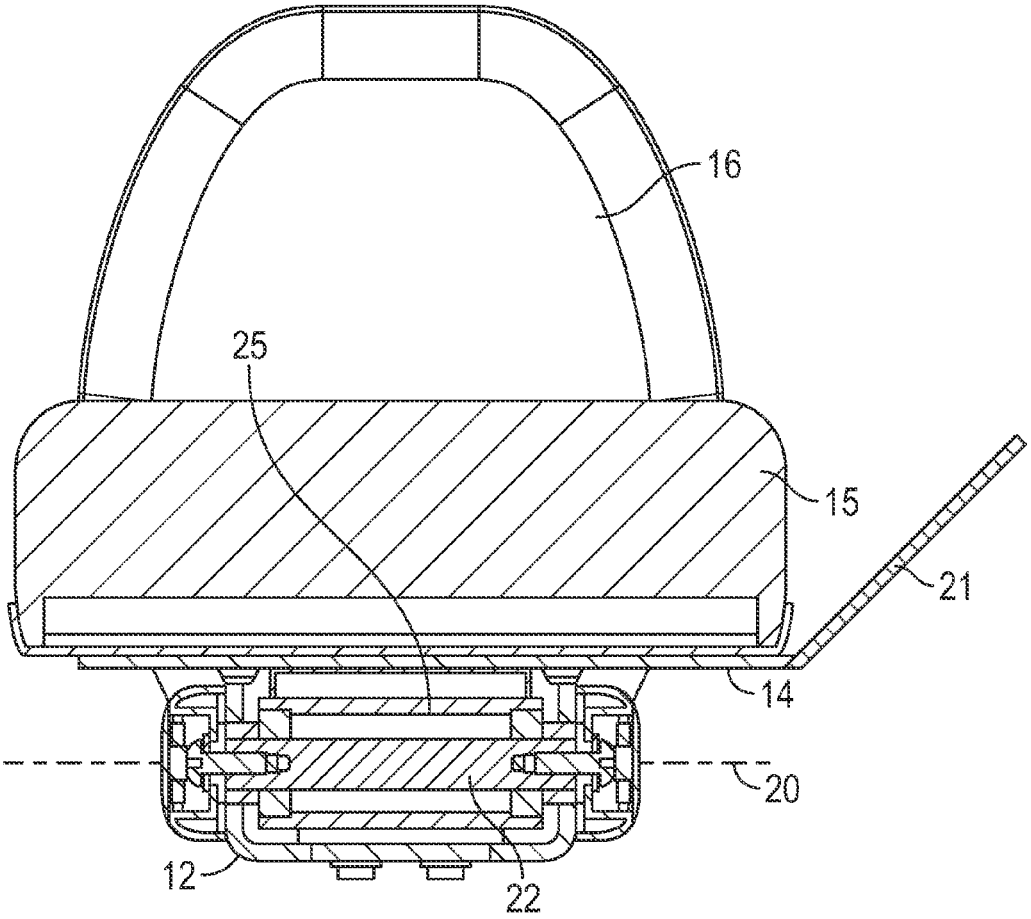
FIG. 6 is a cross-sectional view on the lines 6-6 of FIG. 3.
Figure 7:
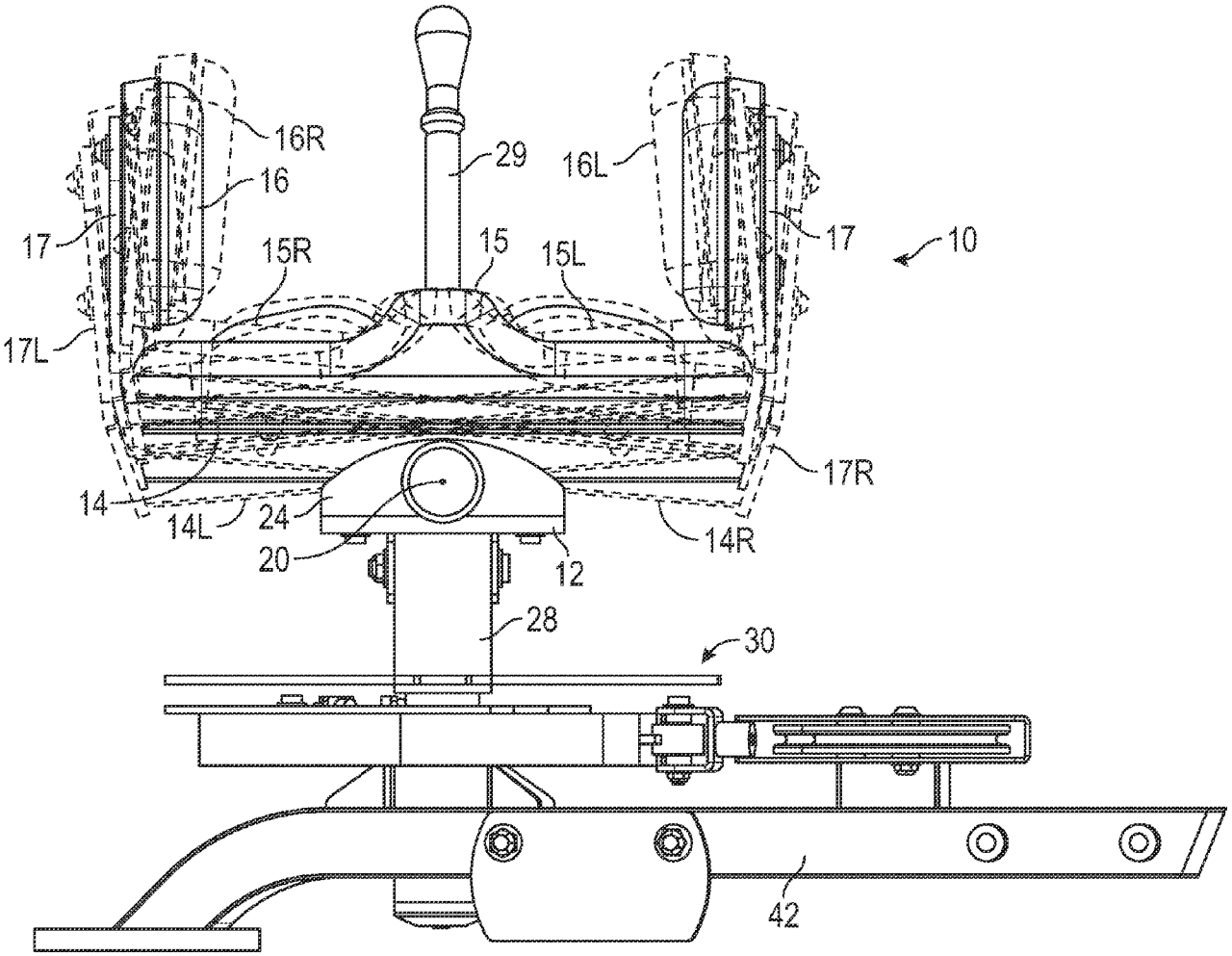
FIG. 7 is a front elevation view of the user support device similar to FIG. 1 but illustrating right and left tilted positions in dotted outline.

The user support platform 14 of the unstable user support device 10 can pivot from side to side relative to support bracket 12 about the horizontal pivot axis 20 by an amount determined by the height of rubber bumper pads or stops 26. FIG. 4 illustrates a balanced, centered or 0 degrees orientation of the user support platform 14 in which the platform does not contact either bumper pad. In the illustrated embodiment, the user support can pivot down to the left or the right about axis 20 through an angle of 0 to around 5 degrees in either direction before contacting a bumper pad or stop 26. FIG. 5 illustrates the platform 14 pivoted downwardly on the right hand side (i.e. the right hand side of a user kneeling on the user support pad facing in a forward direction) through 5 degrees, with the lower surface of platform 14 contacting the right hand bumper pad 26 to limit the downward rotation to about five degrees. The platform can similarly pivot downwardly on the left hand side to contact the left hand bumper pad. FIG. 7 illustrates the end positions of the user support platform in dotted outline superimposed over the balanced position of FIG. 4, with reference numbers ending in an R representing rotation to the right (clockwise as viewed in FIG. 7) and reference numbers ending in an L representing rotation to the left (anti-clockwise as viewed in FIG. 7). Thus, the user support platform in the illustrated embodiment has a degree of instability of five degrees off horizontal from side to side. A user kneeling on the user support must use core muscles in order to maintain the platform in a stable, horizontal position while performing an exercise.

Although the user support platform tilts from side to side about a horizontal pivot axis extending in a front to rear direction in the illustrated embodiments, other embodiments may have different pivot joints between platform 14 and mounting bracket 12 to allow pivoting about different pivot axes or in different planes, for example a universal joint to provide instability in all directions, or a horizontal pivot axis perpendicular to axis 20 to permit pivoting down at the front and rear of the platform 14. Additionally, although the user support platform is oriented horizontally in the illustrated embodiment, it may be slightly tilted or angled downwards or upwards when mounted on an exercise machine support structure in other embodiments, depending on the type of exercise. In such alternatives, the axis 20 is not horizontal but extends parallel to the plane of the user support platform, and the platform still tilts from side to side about the axis 20.

In the illustrated embodiment, the user support platform pivots freely up and down between zero and five degrees on each side about pivot axis 20. In an alternative embodiment, a releasable locking mechanism may be provided to secure user support platform 14 in the horizontal orientation of FIG. 4 if a user wishes to perform the exercise without core muscle involvement.

FIGS. 8 to 16 illustrate one embodiment of an exercise machine 40 incorporating the unstable kneeling user support device 10 of FIGS. 1 to 7. User support device 10 is identical to the device shown in FIGS. 1 to 7 and described above, and like reference numbers are used for like parts as appropriate. The exercise machine in this case is a rotary torso machine in which the user rotates their lower torso between left and right swiveled positions relative to the upper torso, back into an aligned, front facing position relative to the upper torso. However, it will be understood that the user support device 10 may be used on other exercise machines for performing different exercises in other embodiments.

Figure 8:
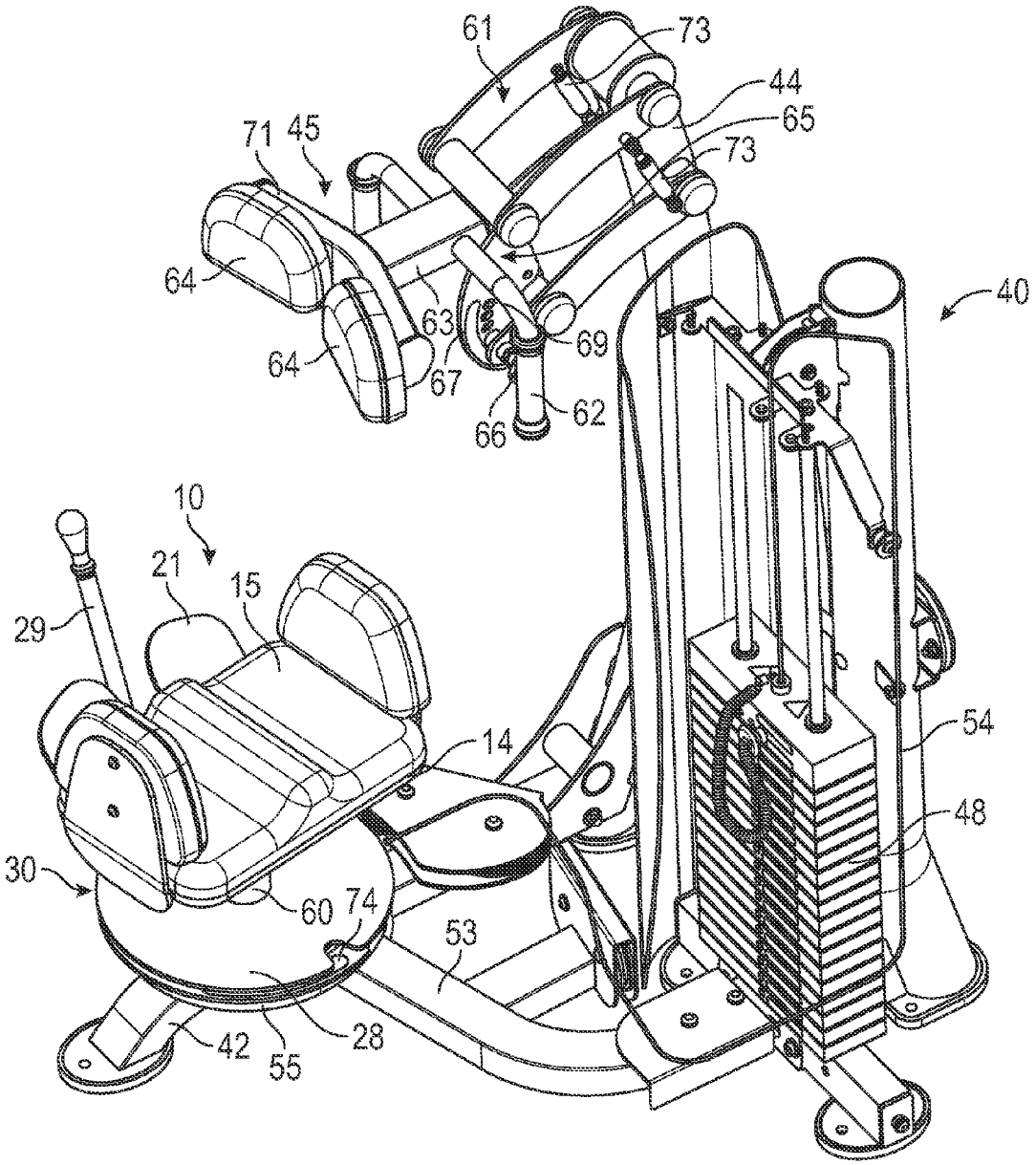
FIG. 8 is a perspective view of a rotary torso exercise machine incorporating the unstable user support device of FIGS. 1 to 5, with the user support device positioned in a first start position and the weight stack housing removed to reveal the exercise resistance cable routing.
Figure 11:
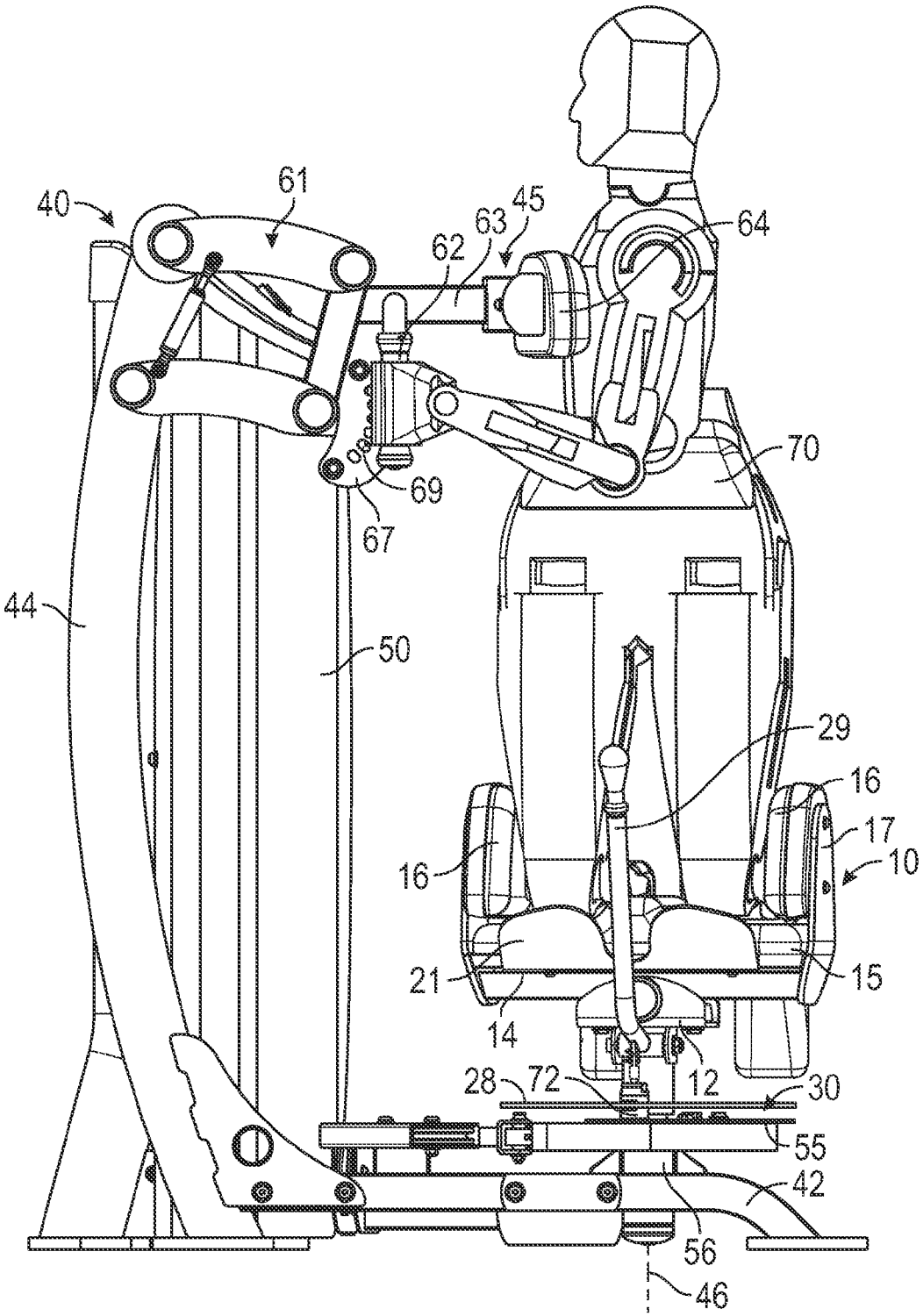
FIG. 11 is a side elevation view of the rotary torso exercise machine in the start position of FIG. 8, with a user in a kneeling position on the user support pad ready to start an exercise.

Rotary torso exercise machine 40 basically comprises a main frame having a base strut 42 and a main upright 44, an upper torso stabilizing assembly 45 mounted at the upper end of main upright 44, and unstable kneeling user support device 10 mounted on rotational pivot assembly 30 supported on the base strut 42 of the main frame and configured for rotation of the user support device about vertical pivot axis 46 (see FIG. 11). In this embodiment, exercise resistance is provided by a selectorized weight stack 48 located in weight stack housing 50 secured to the vertical upright 44 via cross bar 52 and to base strut 42 via cross member or guide tube 53. A selected amount of weight is secured to the rotating upper part of pivot assembly 30 via one or more cables 54 extending around various guide pulleys in a conventional manner, as illustrated in FIG. 8. Other types of exercise resistance may be provided in alternative embodiments.

Rotational pivot assembly 30 comprises a lower plate 55 secured to base strut 42 via mounting post 56, and an upper, rotating plate or turntable 28 rotatably mounted on lower plate 55 via a pivot pin at the center of plate 55 which is rotatably engaged in hollow mounting tube 60 which extends upwards from turntable 28. Mounting bracket 12 of the kneeling user support device 10 is secured to the upper end of mounting tube 60. Turntable 28 and mounting tube 60 together form the upper, rotating part of the pivot assembly 30. The rotational range adjustment lever 29 is pivotally secured to the mounting tube 60 and extends outwardly and upwardly at an angle from tube 60 so that it is conveniently located for gripping by a user kneeling on the platform in order to adjust the starting position for a rotary torso exercise. A user can adjust the user support device to a desired exercise starting position at an angle to the right or left of a forward facing position in alignment with the upper torso by gripping and pulling the handle and rotating the user support device to the desired position, as described in more detail below.

Figure 9:
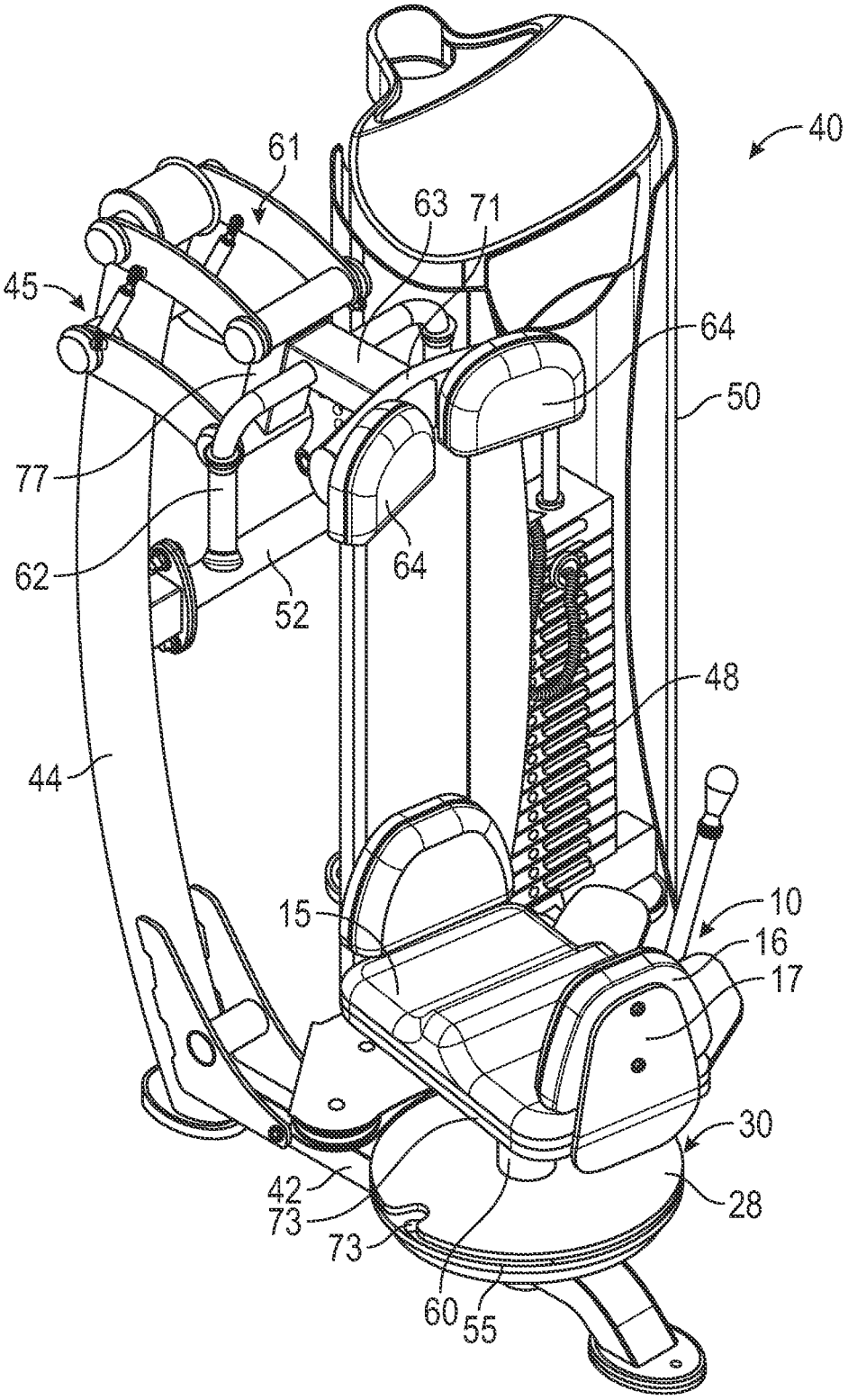
FIG. 9 is a perspective view of the machine of FIG. 8 with the weight stack housing included and the user support device positioned in a second, oppositely directed start position for a rotary torso exercise.

The upper torso stabilizing assembly 45 is secured to main upright 44 via four bar pivot assembly 61 and comprises a pair of stabilizing handles 62 and a pair of upper torso stabilizing pads 64 for engaging the user's chest. Support post 77 extends upward from a cross bar extending between the forward ends of the lower bars of pivot assembly 61, and handles 62 and pads 64 are mounted on post 77 via mounting bar 63 and cross bar 71, as best illustrated in FIGS. 8 and 9. A range of motion (ROM) device 65 between the upper and lower bars of the four bar pivot assembly allows user adjustment of the height of chest pads 64 and handles 62 so that the pads are at chest level. Device 65 comprises ROM plate 67 also secured to support post 77 and having a series of openings 69. Range of adjustment knob 66 is mounted on a forward end of one of the lower bars of the pivot assembly, as illustrated in FIG. 8, and extends into an aligned opening in ROM plate 67. Range adjustment knob 66 is released from the ROM plate 67 by a user to allow the height of the pads to be adjusted, and is then released to engage in the appropriate opening when the pads are at the desired chest level height. Gas springs 73 extend between the upper and lower bar of the four bar pivot assembly on each side of the assembly.

Figure 12:
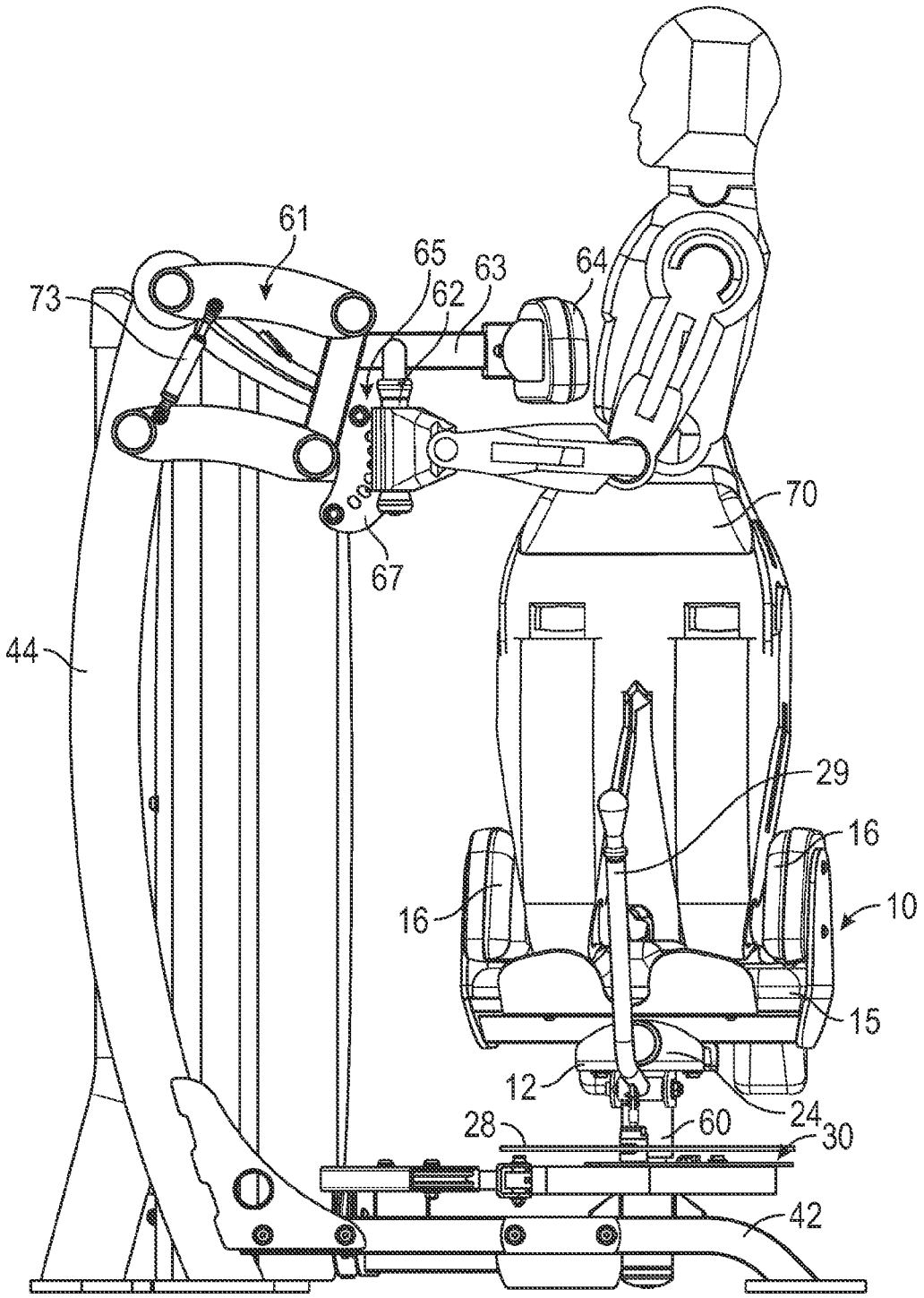
FIG. 12 is a side elevation view similar to FIG. 11 but with the user in an alternative start position in which they do not engage the upper torso support for an added level of core muscle engagement when performing an exercise.
Figure 13:
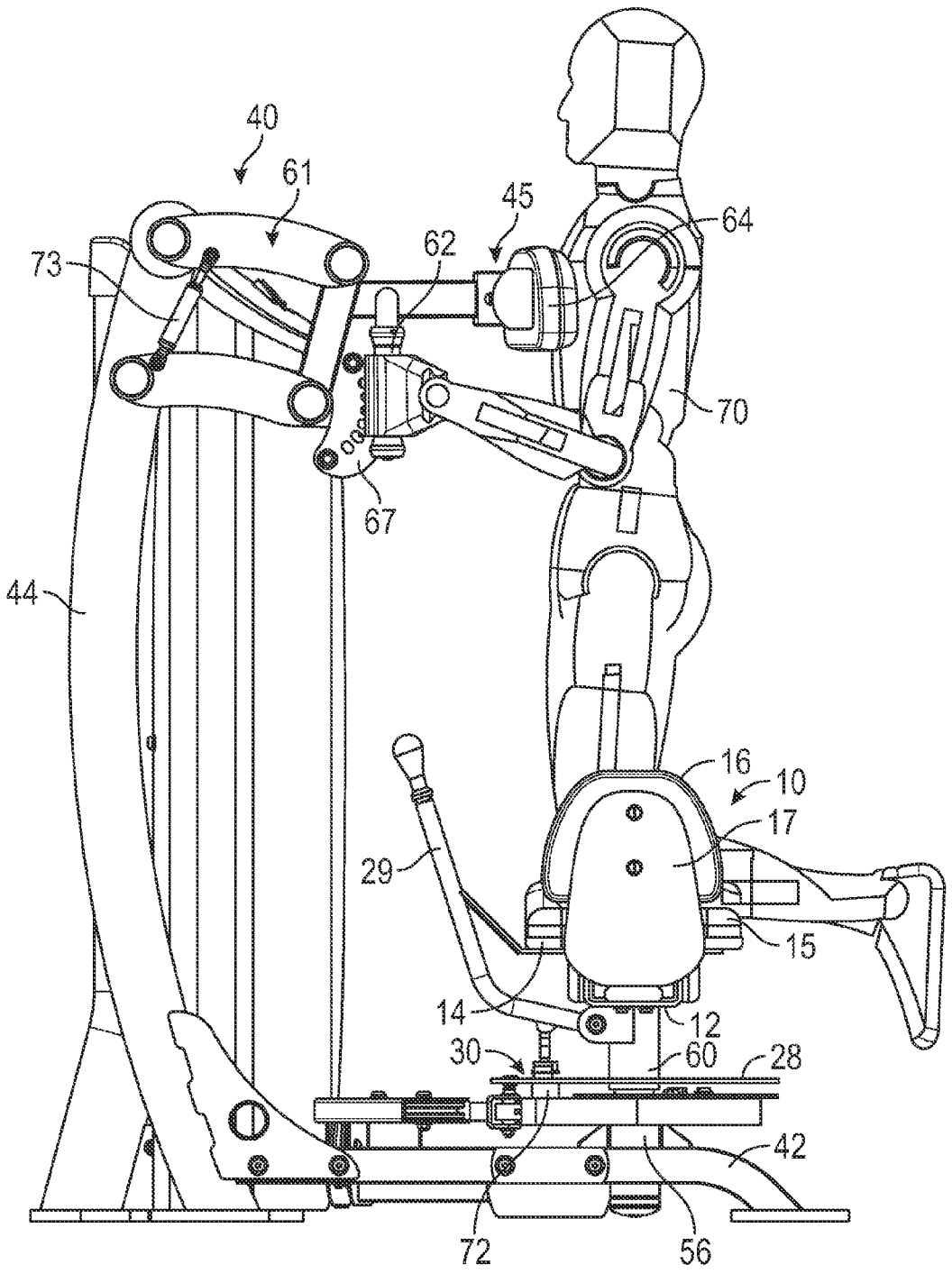
FIG. 13 is a side elevation view similar to FIG. 11 but with the user's lower torso and the user support device rotated into alignment with the upper torso and facing forward in an end position of a first rotary torso exercise.
Figure 14:
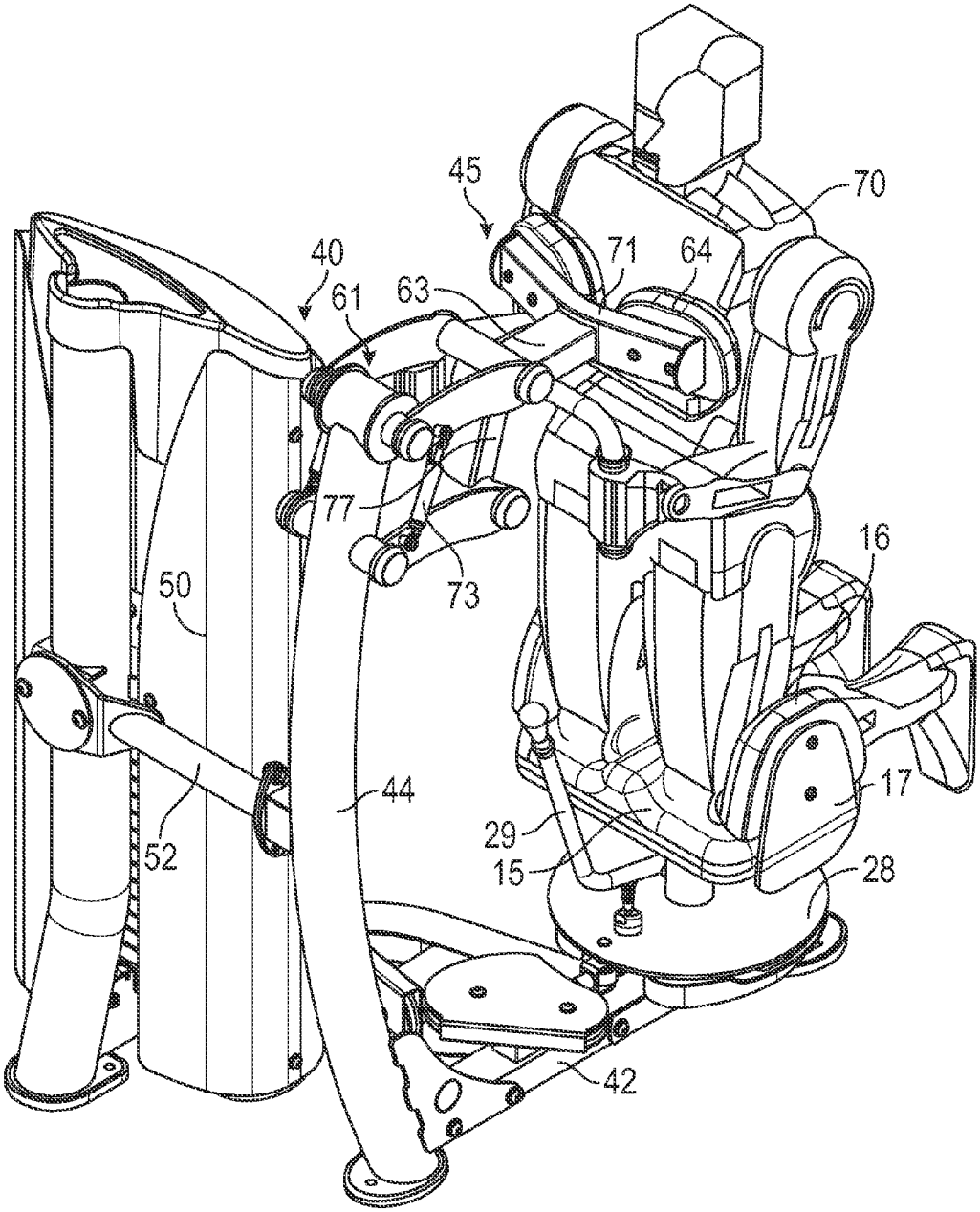
FIG. 14 is a front perspective view of the user and user support device in the position of FIG. 13.
Figure 15:
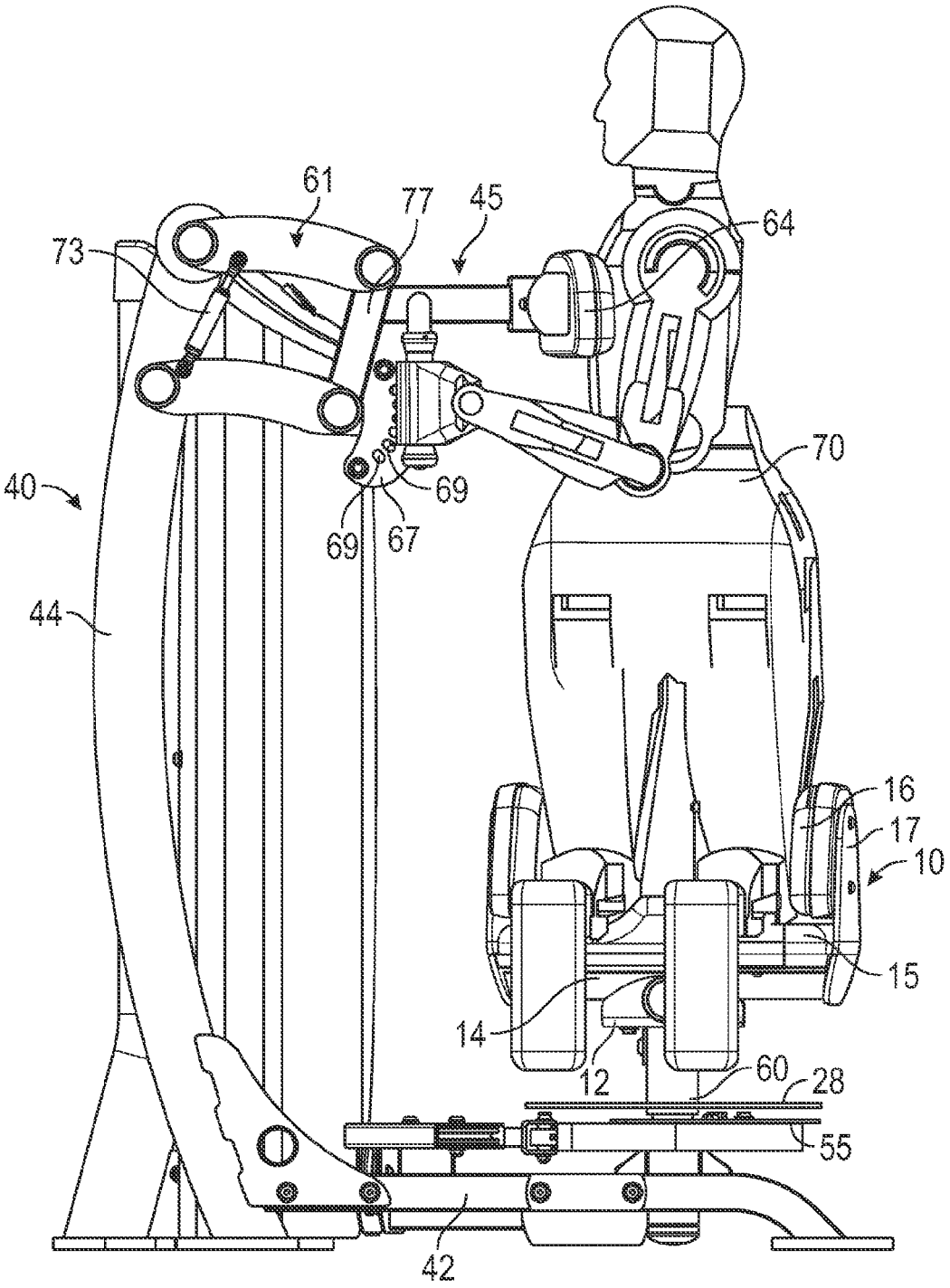
FIG. 15 is a side elevation view similar to FIG. 11, but with the user support device in the second start position of FIG. 9 and a user kneeling on the user support pad and ready to perform the exercise.
Figure 16:
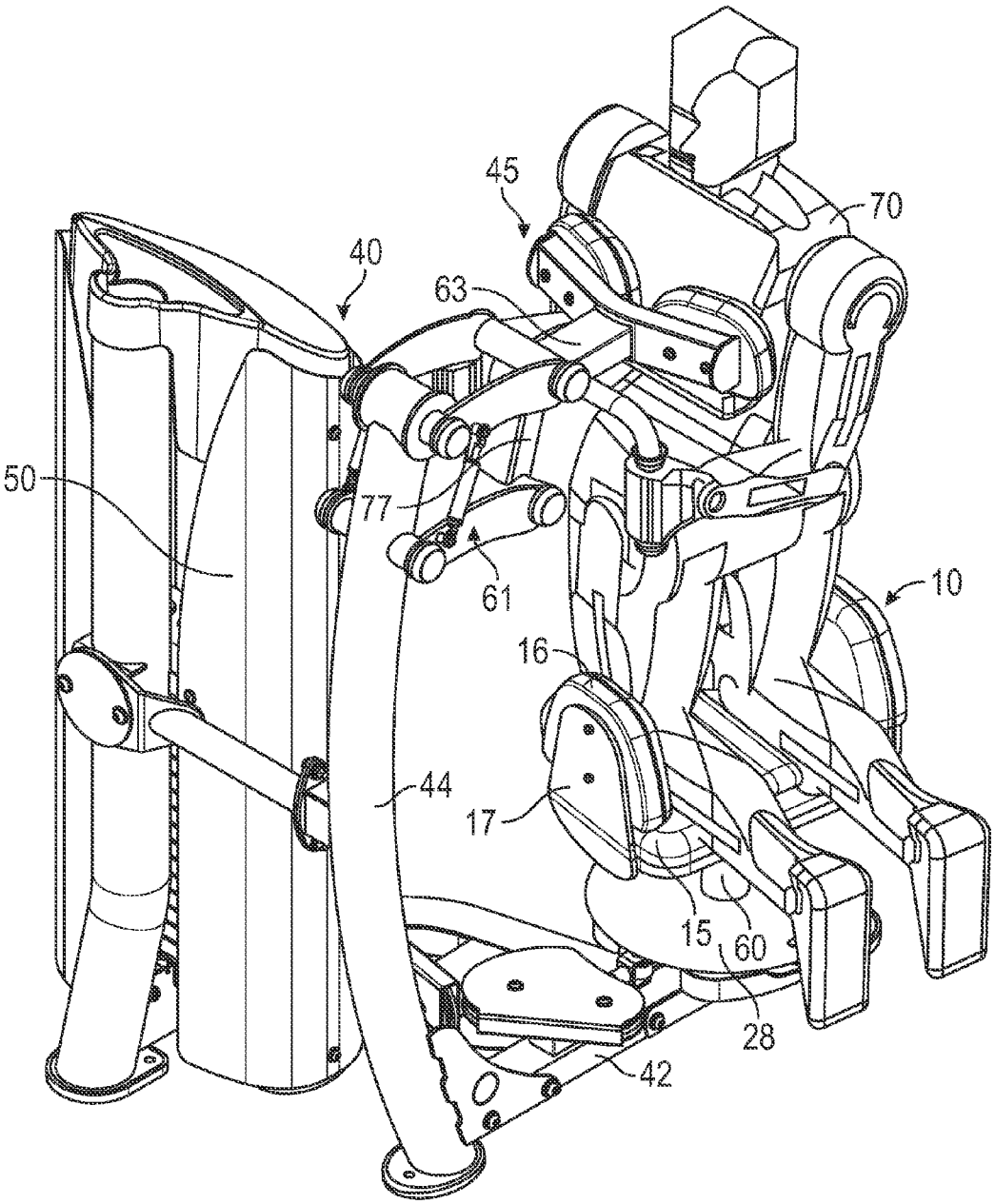
FIG. 16 is a front perspective view of the user support and user in the position of FIG. 15.

FIGS. 8 and 10 illustrate a first start position for a rotary torso exercise in which the user support device 10 is rotated to the left of a central position in alignment with the upper torso stabilizing assembly 45. The central position is illustrated in FIGS. 13 and 14 with a user 70 kneeling on the user support and engaging the upper torso stabilizing assembly. In the central position, the user support device 10 faces the main upright and the lower torso of a user kneeling on the support pad 15 is aligned with the upper torso. FIG. 9 illustrates a second start position for a rotary torso exercise in which the user support device 10 is rotated to the right of the central position. The start position may be adjusted by the user by gripping the handle of adjustment lever 29, pulling it towards their body so as to lift pin 72 (FIGS. 11-13) out of slot 73 or 74 in the lower fixed plate or base plate 55 of pivot assembly 30, then rotating the user support device into the desired adjusted position and releasing the lever 29 so that the pin 72 drops back into aligned slot 73 or 74. The angular length of slots 73 and 74 controls the amount of rotation of the lower torso relative to the upper torso.

In order to perform the exercise, the user 70 first adjusts the kneeling user support device 10 to the desired starting position, i.e. degrees of exercise range to rotate lower torso to face forward alignment with upper torso. Exercise is performed in one direction, starting either from the position of FIG. 8 or FIG. 9, then the user re-adjusts the platform or support device 10 to exercise in the opposite direction. Once the user support device 10 is in the desired start position, user 70 assumes a kneeling upright position on the kneeling platform, as illustrated in FIG. 11 for the starting position of FIGS. 8 and 10. Note that the kneeling platform rocks side to side about axis 20 during this positioning, which requires balancing using core muscles to keep level.

The upper torso stabilizing pads/handles assembly 45 is then adjusted so the pads 64 are at chest level, using ROM device 65. Once the pads are locked in position, the user grasps the handles and pulls their chest tight to pads for stabilization, as illustrated in FIG. 11. Alternatively, the exercise may be performed using handles 62 only to stabilize the upper torso, keeping the chest off the pads 64 during the exercise, as illustrated in FIG. 12. This provides an added level of core engagement.

Once the user is properly positioned on the kneeling platform or user support device 10, while gripping handles 62 and optionally engaging the chest pads of the upper torso support assembly 45, the user's lower torso is in a rotated away position from the upper torso. In the start position of FIG. 12, the lower torso is rotated to the left relative to the upper torso. In order to perform the exercise motion, the user rotates the lower torso into alignment with the stabilized face forward position of the upper torso, using a slow controlled movement, and ending up in the end position of FIGS. 13 and 14. During this movement, the user exercises core muscles in order to keep the kneeling platform 14 of unstable user support device 10 balanced during the movement. The lower torso and user support device are then rotated back to the starting position of FIG. 11 and the exercise is repeated for the desired number of repetitions. The platform is then readjusted to the opposite starting position of FIG. 9, the user 70 kneels back on the kneeling pad 15 in the position of FIGS. 15 and 16, and again grips the handles 42 and pulls the chest pads 64 in to their chest. In this start position, the lower torso is rotated to the right of the upper torso. They then rotate their lower body on the user support device 10 back into the forward facing end position of FIGS. 13 and 14, and the exercise is repeated for the desired number of repetitions. Load bearing cable 54 linked to the selected number of weights in weight stack 48 provides the desired amount of resistance to rotation of the user support device between either start position and the end position.

The kneeling platform or user support device 10 is designed to provide a level of instability for the purpose of greater challenging the core muscles to balance the platform while performing the exercise motion. The kneeling platform instability may be provided in any or all planes to aid in engaging the core muscles. The unstable plane selection for the user support device of FIGS. 1 to 16 is left to right or side to side. The degree of instability is approximately 5 degrees off horizontal, left or right. The rubber bumper pads 26 (FIGS. 4, 5 and 7) contact the undersurface of the platform when tilted through five degrees to the left or right, limiting the amount of instability. Different degrees of instability may be provided in alternative embodiments by bumper pads of different heights, for example the platform may be tiltable through an angle in the range of about 3 to 10 degrees off horizontal. The more weight stack resistance selected, the greater degree of aided core muscle engagement necessary to keep the kneeling platform balanced. For an added level of core engagement, the handles alone may be used to stabilize the upper torso while keeping the chest off the pads during the exercise motion.

Figure 17:
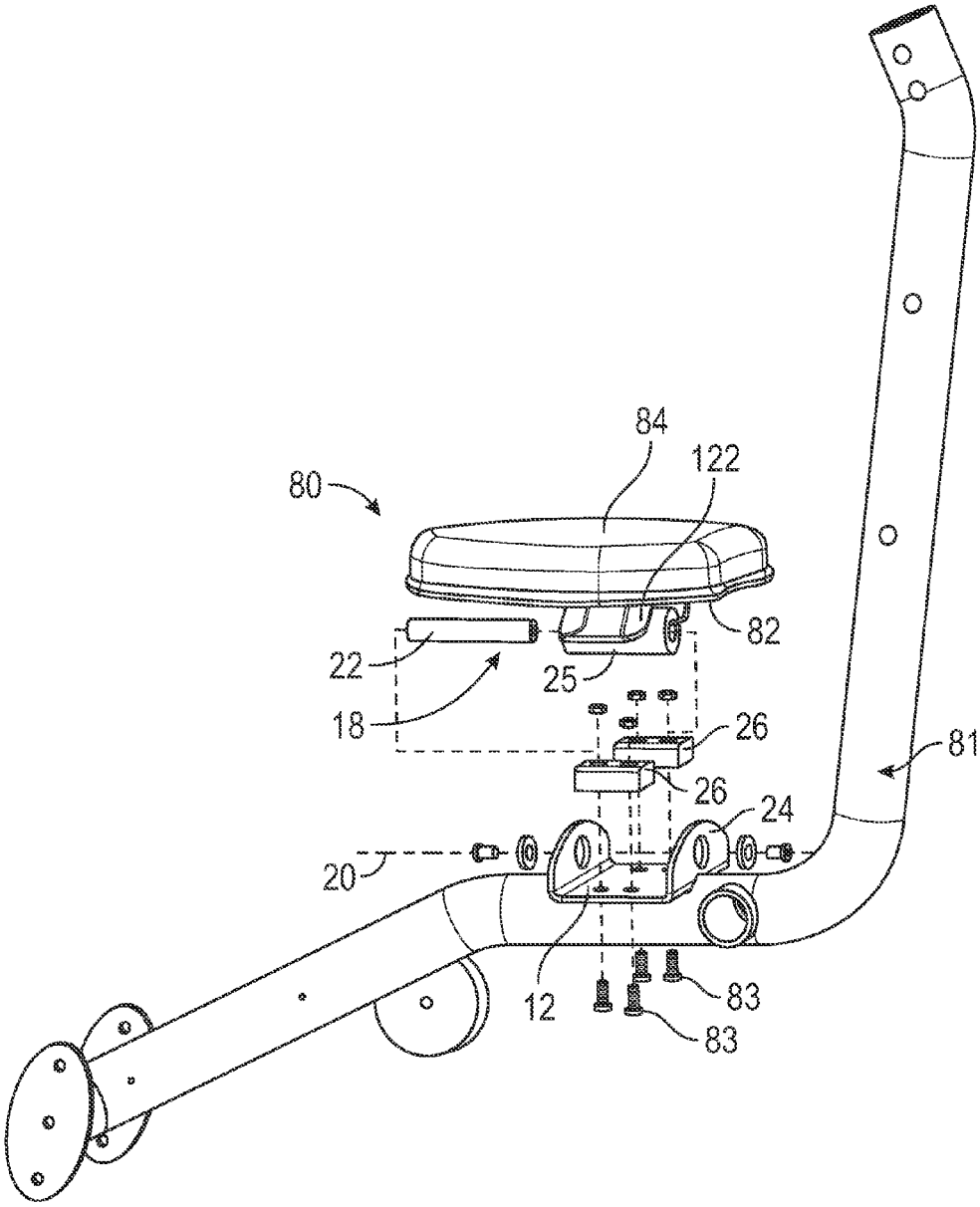
FIG. 17 is an exploded view of a second embodiment of an unstable user support device for mounting on part of a user support member of an exercise machine.
Figure 18:
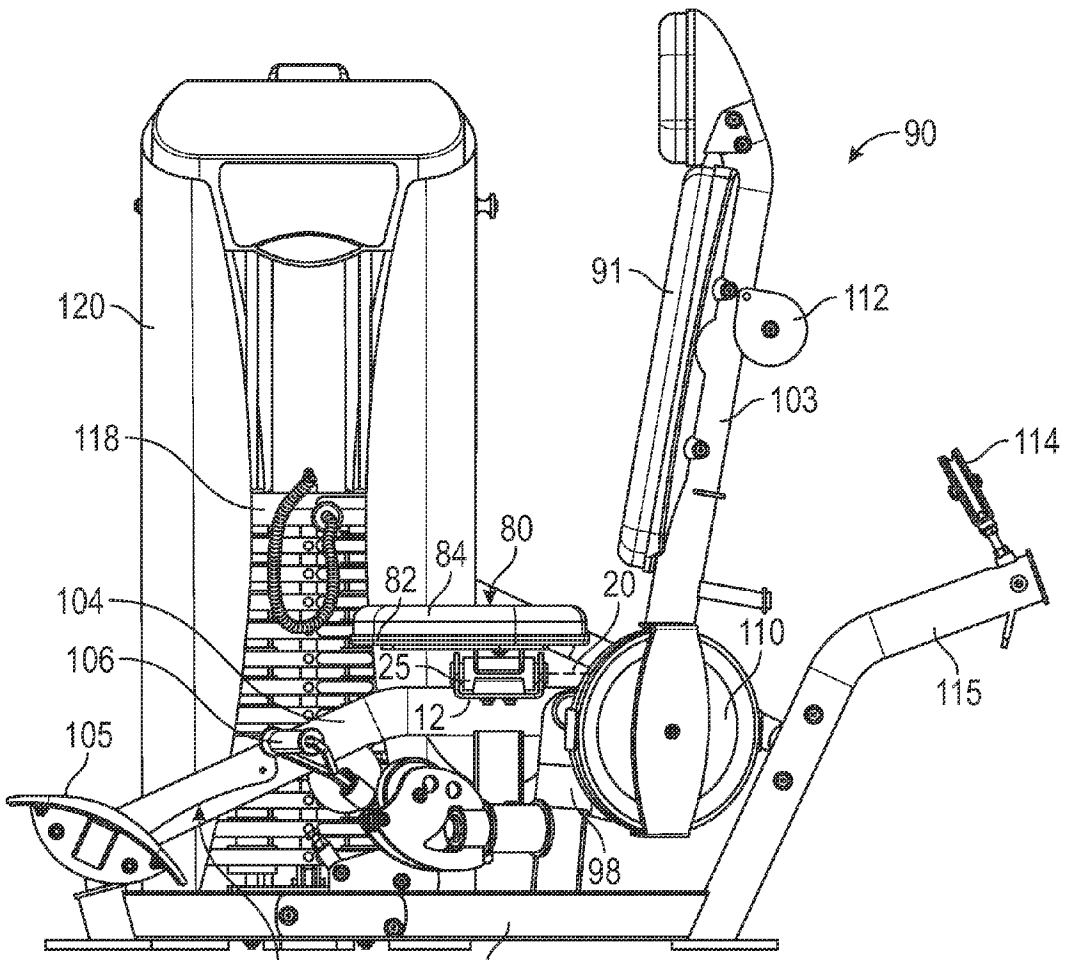
FIG. 18 is a side elevation view of one embodiment of an arm exercise machine incorporating the unstable user support device of FIG. 17.
Figure 19:
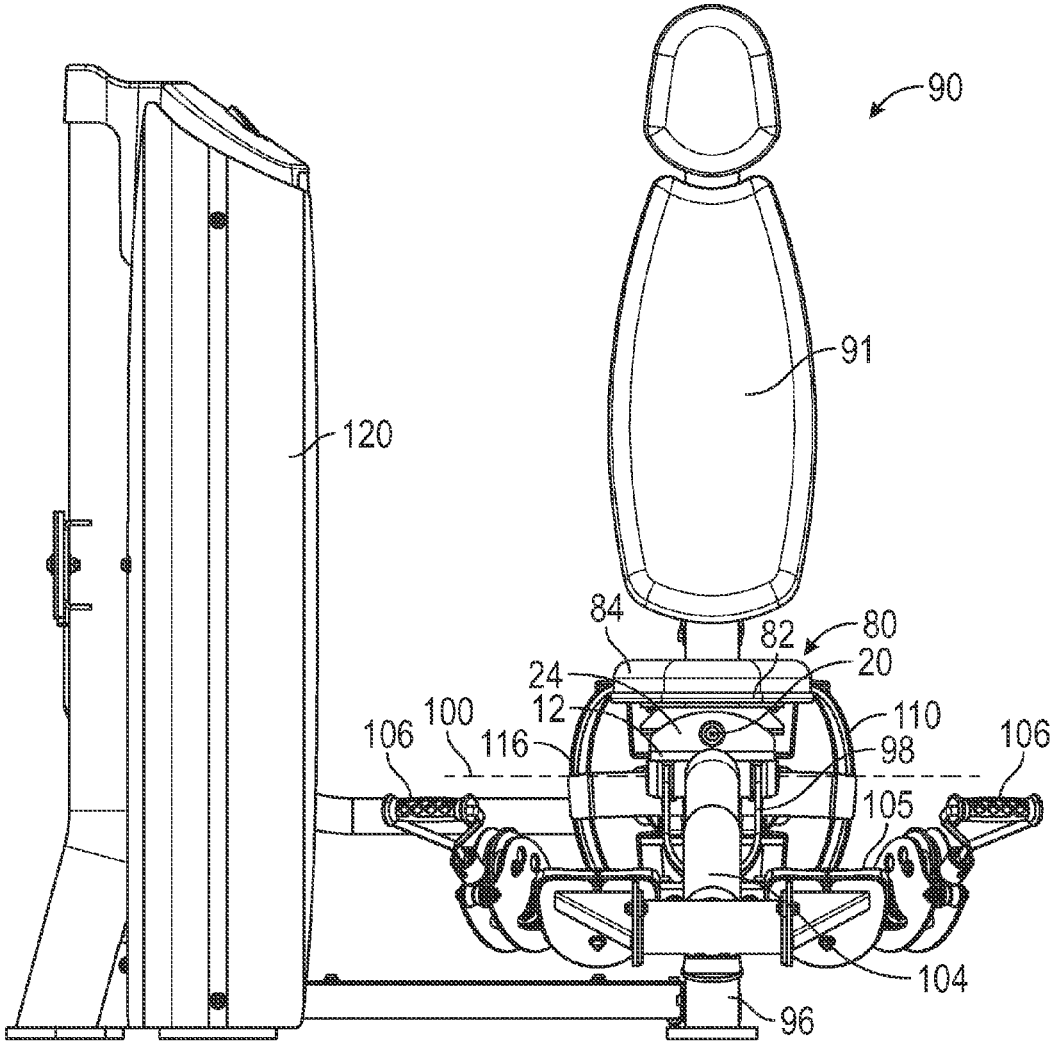
FIG. 19 is an enlarged front elevation view of the exercise machine of FIG. 18.

The unstable user support device 10 in the previous embodiment is designed to support a user in an upright kneeling position. In alternative embodiments, the unstable user support device may be designed to support users in different positions, such as seated positions. FIG. 17 illustrates a second embodiment of an unstable user support device 80 which is designed for supporting a seated user. Device 80 may be used to replace a stable user support seat on an exercise machine designed for supporting a seated user. FIG. 17 is an exploded view showing device 80 ready for mounting on a base support strut or arm 81 of an exercise machine in place of a conventional, fixed user support or seat.

Some examples of exercise machines on which unstable seated user support device 80 may be used are upper body exercise machines such as biceps curl exercise machines, seated mid row exercise machines, pec fly exercise machines, and chest press and shoulder press exercise machines. Some examples of such exercise machines on which unstable user support device 80 may be used are the RS-1102 biceps curl exercise machine, the RS-1203 seated mid row exercise machine, the RS-1302 pec fly exercise machine, the RPL-5301 chest press exercise machine, and the RS-1501 and RPL-5501 shoulder press exercise machines which all have rocking seats and are manufactured by Hoist Fitness Systems, Inc. of San Diego, Calif., or any of the rocking user support exercise machines described in U.S. Pat. Nos. 7,717,832, 7,760,269, 7,766,802, 7,794,371, 7,901,337, 7,938,760, 7,976,440, 7,981,010, 7,993,251, and 8,002,679 of Hoist Fitness Systems, Inc. The unstable user support device 80 may also be used on other types of exercise machines with rocking and non-rocking seated user supports in alternative embodiments.

Unstable user support device 80 is similar to the unstable kneeling user support device 10 of the previous embodiment, and like reference numbers are used for like parts as appropriate. The main difference is the replacement of the kneeling support platform and pads with seated support platform 82 on which seat pad 84 is mounted. Seated support platform is mounted on base support or mounting bracket 12 via pivot connection 18 which rotatably secures platform 82 to mounting bracket 12 for rotation about a pivot axis 20 directed between the front and rear ends of the user support device, so that the seated support platform rocks from side to side as in the previous embodiment. As in the previous embodiment, the pivot connection 18 comprises a pivot pin 22 secured between end portions 24 of mounting bracket 12 and rotatably engaged in pivot sleeve 25 secured to the lower surface of user support platform 82 via mounting bracket 12. Rubber bumper pads 26 are secured on opposite sides of the pivot axis by fasteners 83, and control the range of pivoting of the seat as in the previous embodiment. Pads 26 may also be positioned so that the seat rocks through about five degrees from the horizontal orientation on each side before engaging the respective bumper pad. Mounting bracket 12 is secured in a seat on the upper surface of support post or base support strut 81 by welding, bolting or the like, so that unstable user support device 80 can be used on an exercise machine in place of the standard stable seated user support, as described below for one type of exercise machine.

FIGS. 18 to 22 illustrate unstable user support device 80 of FIG. 17 installed on a biceps curl exercise machine 90 for supporting a seated user while performing biceps curl exercises. The unstable seated user support platform or device 80 may be used in conjunction with a back rest or back pad 91 as illustrated, or may be used on its own, depending on the type of exercise involved. In the illustrated embodiment, arm exercise machine 90 has a rocking user support, but it will be understood that unstable user support device 80 may be installed on any exercise machine designed for engagement by a user in a seated position. Apart from the unstable user support device 80, exercise machine 90 of FIGS. 18 to 22 is the same as the RS-1102 Biceps Curl Exercise Machine of Hoist Fitness Systems, Inc. of San Diego, Calif., as referenced above.

Figure 20:
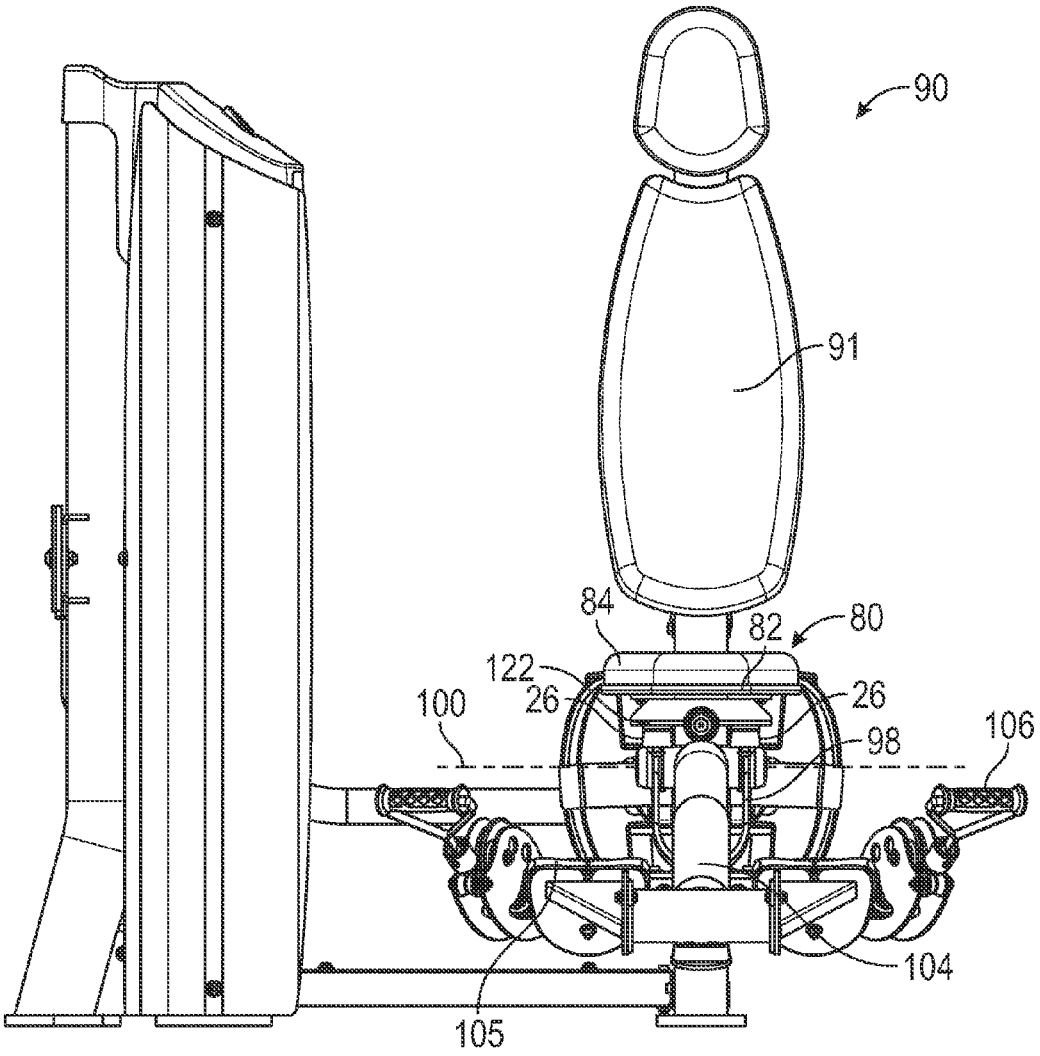
FIG. 20 is a front elevation view similar to FIG. 19 with a front portion of the user support mounting bracket removed to reveal the bumper pads.

Machine 90 includes a main frame and a user support assembly including a seat support tube or frame 81 pivotally mounted on the base strut 96 of the main frame by means of pivot mount 98 for rearward and forward rotation about horizontal pivot axis 100 (see FIG. 20). The seat support tube or frame 81 is generally "L" shaped, with a rear upright 103 and a forwardly extending leg 104 with foot rests 105 mounted at the forward end of leg 104. Back pad 91 is mounted on the rear upright 103. In the RS-1102 machine described above, a seat pad is mounted at a fixed position on a mounting post on the forwardly extending leg 104 of the user support tube, at the appropriate position relative to the back pad 91. A telescopic mounting arrangement may be used to allow the height of the seat pad to be adjusted, but the seat pad in the existing machine is otherwise fixed in position relative to the seat support tube and back pad. In this embodiment, the existing seat pad is removed from the telescopic mounting post and replaced by unstable user support device 80 which is mounted on leg 104 as illustrated in FIG. 17, at a location spaced forward from rear upright 103. Mounting bracket 12 may alternatively be adjustably mounted on leg 104 for adjusting the height of seat pad 84.

Figure 21:
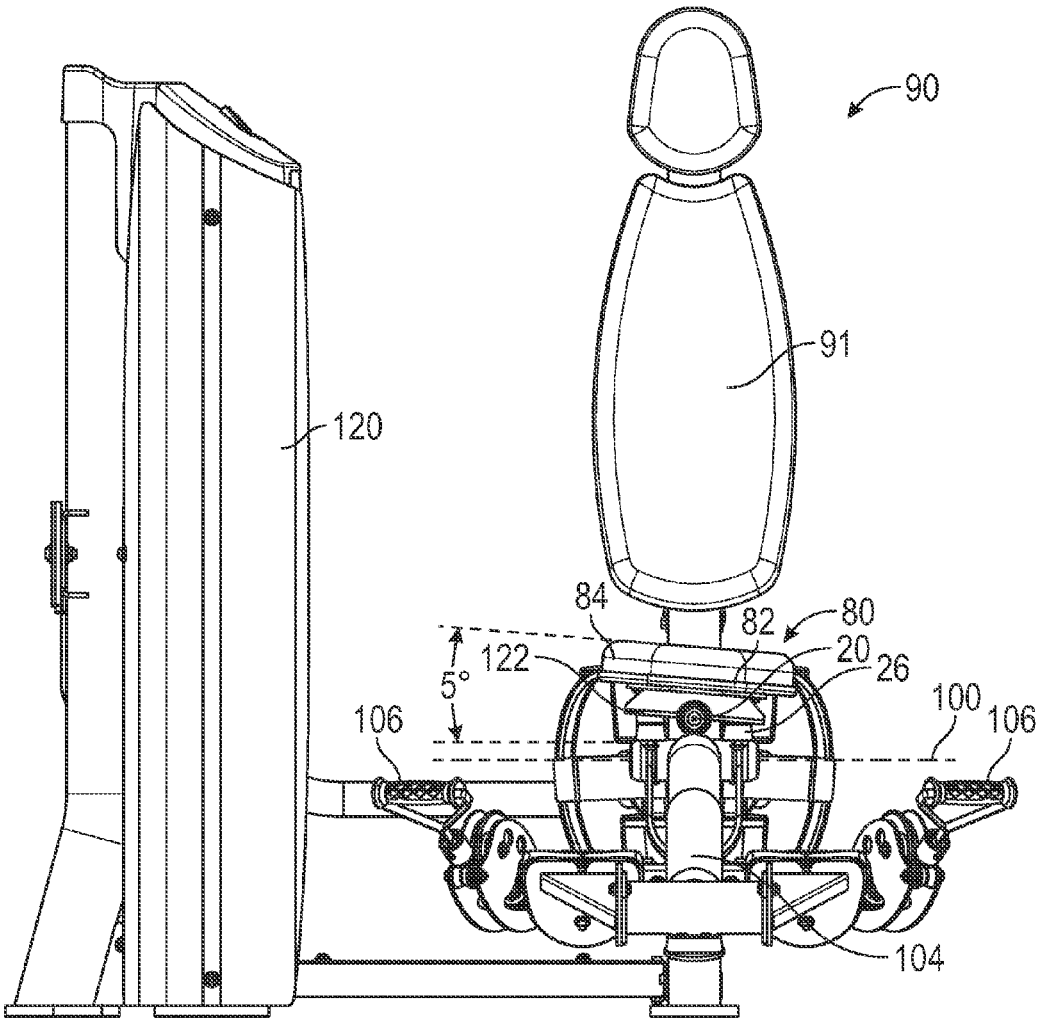
FIG. 21 is a front elevation view similar to FIG. 20 illustrating the user support tilted in one direction and engaging one of the bumper pads.
Figure 22:
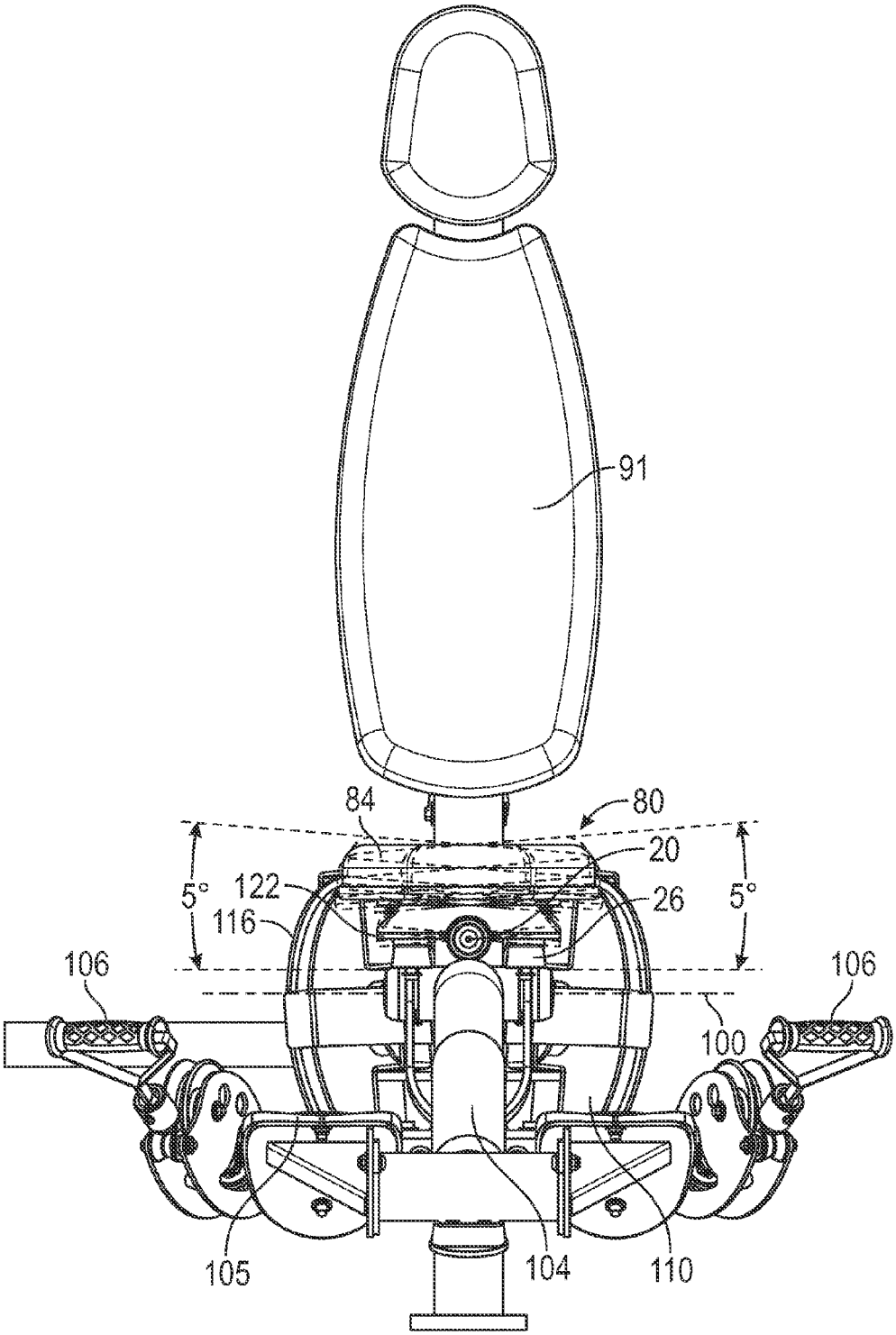
FIG. 22 is a front elevation view similar to FIG. 20 but has an overlay illustrating tilting of the user support in both directions in dotted outline.

User engageable handles 106 on each side of the user support assembly are secured to ends of a cable exercise arm assembly including at least one cable (not illustrated) extending between the handles in a selected cable route which includes first and second dual diameter double pulleys or cams 110, 116 on opposite sides of the user support, a pair of pulleys 112 on rear upright 103 of the user support assembly, and a rear pulley 114 on main frame rear upright 115. A weight stack 118 housed in a vertical weight stack housing 120 provides exercise resistance. The weight stack 118 is linked to the user support assembly by a cable and pulley linkage. The arrangement is such that pulling up on handles 106 in a biceps curl exercise simultaneously rocks the user support assembly rearwards about pivot axis 100 against the exercise resistance, between the generally upright position of FIG. 18 into a rearwardly reclined position. At the same time, the unstable user seat pad is free to tilt from side to side about instability pivot axis 20 which extends perpendicular to the rocking user support pivot axis 100, as seen in FIGS. 19 to 22. The user seated on seat pad 84 engages core muscles to balance the seat platform in a stable, central position while performing a biceps curl exercise In FIGS. 20 to 22, the front end portion or plate 24 of mounting bracket 12 is removed to reveal the bumper pads 26. The user support platform 82 is in a centered, 0 degree orientation in FIG. 20. FIG. 21 illustrates the seat tilted down on the seated user's left hand side until the lower part or pivot sleeve mounting bracket 122 at the bottom of platform 82 on one side of pivot sleeve 25 contacts bumper 26. FIG. 22 illustrates left and right downwardly tilted unstable positions in dotted outline. In the illustrated embodiment, the user support can pivot down to the left or the right about axis 20 through an angle of 0 to around 5 degrees in either direction before contacting a bumper pad or stop 26. Thus, seated user support platform 82 in the illustrated embodiment has a degree of instability of five degrees off a level or centered orientation from side to side. Although the seat starts from a horizontal centered orientation in FIG. 20, it will be understood that the same side-to-side instability continues throughout an exercise as the user support tilts rearward about axis 100 during the exercise. A user seated on the user support pad 84 and performing biceps curl exercises on the machine 90 uses core muscles in order to maintain the platform in a stable, level position while performing the exercise, while the user support assembly simultaneously tilts rearward about pivot axis 100.

The unstable user support devices described above allow for tilting of a user support platform from side to side through a limited angle, so as to involve core muscles to stabilize the support platform while performing various types of exercises, including exercises performed in kneeling and seated positions. Although the tilting is from side to side in the described embodiments, tilting about different axes may be provided in alternative embodiments, including an alternative embodiment with a universal or multi-directional pivot connection between the mounting bracket or base and the user support platform. The instability of the user support platform may therefore be provided in multiple directions or planes, and through any desired angular range. The instability of the user support platform challenges the core muscles in balancing the platform while performing the exercise, providing enhanced exercise and training.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

We claim:

1. An unstable user support for supporting a user in a kneeling position while performing an exercise on an exercise machine, comprising:

a base having a U-shaped base mounting bracket;

an unstable user support platform configured to support a user in a kneeling position while performing an exercise;

the unstable user support platform pivotally mounted on the base for free rotational tilting movement about at least one non-vertical pivot axis in at least two opposite directions between first and second tilted end positions, the unstable user support platform having a centered support position between said first and second tilted end positions;

a stop assembly between the base and the unstable user support platform which defines the respective first and second tilted end positions and limits tilting movement from said centered support position in each direction to a predetermined angular range; and a rotational pivot assembly comprising a lower portion and an upper portion, the upper portion comprising a turntable and a mounting post, wherein the U-shaped base mounting bracket is secured to an upper surface of the turntable using the mounting post, and the upper portion of the pivot assembly is rotatably mounted to the lower portion of the pivot assembly.

2. The unstable user support of claim 1, wherein the at least one non-vertical pivot axis is parallel to the unstable user support platform.

3. The unstable user support of claim 2, wherein the stop assembly comprises first and second end stops defining the respective first and second tilted end positions.

4. The unstable user support of claim 3, wherein the first and second end stops comprise resilient bumpers mounted on one of the base and the unstable user support platform on opposite sides of the at least one non-vertical pivot axis.

5. The unstable user support of claim 4, wherein the resilient bumpers are mounted on the base.

6. The unstable user support of claim 1, wherein the predetermined angular range is from zero to approximately 5 degrees.

7. The unstable user support of claim 1, wherein the unstable user support platform includes at least one user support pad having a central axis, and wherein the user support pad is configured for engagement by a user's knees and lower legs on opposite sides of the central axis with the user in a kneeling position.

8. The unstable user support of claim 7, wherein the at least one non-vertical pivot axis is parallel to the central axis of the user support pad and configured for side-to-side tilting movement of the unstable user support platform to the right and left of the centered support position.

9. The unstable user support of claim 1, wherein the U-shaped base mounting bracket includes at least a pair of endplates.

10. The unstable user support of claim 1, wherein the upper portion and the lower portion may be selectively coupled together in at least first and second orientations to provide corresponding first and second exercise starting positions for the unstable user support platform relative to the lower portion.

11. The unstable user support of claim 10, further comprising an adjustment lever configured to selectively couple the upper portion and the lower portion.

12. The unstable user support of claim 1, further comprising an adjustment lever.

13. The unstable user support of claim 12, wherein the unstable user support platform includes an angled guide with a notch for receiving the adjustment lever.

14. A rotary torso exercise machine, comprising:

a main frame;

a lower torso support rotatably mounted on the main frame for rotation about a first, vertical axis between a forward facing position and opposite left and right swiveled positions, the lower torso support configured to support a lower torso of a user;

an upper torso support mounted on the main frame for supporting the upper torso of the user in a fixed position while the lower torso is rotated;

the lower torso support comprising:

a base mounted on the main frame for rotation about the first, vertical axis between the opposite left and right swiveled positions and the forward facing position, an unstable user support platform pivotally mounted on the base for rotation in at least two opposite directions between a centered orientation and first and second tilted orientations about at least one second, non-vertical pivot axis;

a U-shaped base mounting bracket; and a rotational pivot assembly comprising a lower portion and an upper portion, the upper portion comprising a turntable and a mounting post;

the upper torso support comprising:

at least a pair of height-adjustable upper torso stabilizing pads for engaging a user's chest; and a stop assembly between the base and the unstable user support platform configured to limit tilting of the unstable user support platform to a predetermined angular range between the centered orientation and each of the first and second tilted orientations, wherein the U-shaped base mounting bracket is secured to an upper surface of the turntable using the mounting post, and the upper portion of the pivot assembly is rotatably mounted to the lower portion of the pivot assembly.

15. The rotary torso exercise machine of claim 14, wherein the opposite left and right swiveled positions are adjustable to provide adjustable left and right starting positions for a user's lower torso when performing a rotary torso exercise.

16. The rotary torso exercise machine of claim 15, further comprising a load which resists rotation of the lower torso support from the adjustable left or right starting positions to the forward facing position.

17. The rotary torso exercise machine of claim 14, wherein the at least one second, non-vertical pivot axis is horizontal and the centered orientation of the unstable user support platform lies in a horizontal plane.

18. The rotary torso exercise machine of claim 14, wherein the stop assembly comprises first and second end stops defining the respective first and second tilted orientations.

19. The rotary torso exercise machine of claim 18, wherein the first and second end stops comprise resilient bumpers mounted on one of the base and the unstable user support platform on opposite sides of the at least one second, non-vertical pivot axis.

20. The rotary torso exercise machine of claim 19, wherein the resilient bumpers are mounted on the base.

21. The rotary torso exercise machine of claim 14, wherein the predetermined angular range is from zero to approximately 5 degrees.

22. The rotary torso exercise machine of claim 14, wherein the unstable user support platform has at least one user support pad having knee support portions configured to support a user's knees and at least part of the user's lower legs with the user in a kneeling position, and defining a central axis of the user support pad extending between the knee support portions.

23. The rotary torso exercise machine of claim 22, wherein the at least one second, non-vertical pivot axis is beneath and parallel to the central axis of the user support pad and configured for side-to-side tilting movement of the unstable user support platform to the right and left of the centered orientation.

24. The rotary torso exercise machine of claim 14, wherein the upper torso support is mounted on the main frame via a four-bar pivot assembly.

25. The rotary torso exercise machine of claim 24, wherein the four-bar pivot assembly includes a range-of-motion device configured to allow a user to adjust the height of the height-adjustable upper torso stabilizing pads.

26. The rotary torso exercise machine of claim 25, wherein the range-of-motion device includes a range-of-motion plate having one or more openings and an adjustment knob that selectively engages the one or more openings.

27. The rotary torso exercise machine of claim 24, wherein the four-bar pivot assembly includes one or more gas springs.

28. The rotary torso exercise machine of claim 14, further comprising a rotational pivot assembly configured to provide rotatable mounting of the lower torso support on the main frame.

29. The rotary torso exercise machine of claim 28, wherein the rotational pivot assembly includes a lower plate associated with the main frame and an upper rotating portion coupled to the base, the upper rotating portion configured for rotation about the first, vertical axis with respect to the lower plate.

30. The rotary torso exercise machine of claim 29, wherein the upper rotating portion includes a turntable and a mounting post.

31. The rotary torso exercise machine of claim 29, wherein the upper rotating portion and the lower plate may be selectively coupled together when the lower torso support is in the opposite left and right swiveled positions to provide adjustable left and right starting positions for a user's lower torso when performing a rotary torso exercise.

32. The unstable user support of claim 31, further comprising an adjustment lever configured to selectively couple the upper rotating portion and the lower plate.

33. A rotary torso exercise machine, comprising:

a main frame;

a lower torso support rotatably mounted on the main frame for rotation about a first, vertical axis between adjustable left and right exercise starting positions and a forward-facing exercise finishing position, the lower torso support configured to support a lower torso of a user;

an upper torso support mounted on the main frame for supporting the upper torso of the user in a fixed position while the lower torso is rotated;

the lower torso support comprising:

a base mounted on the main frame for rotation about the first, vertical axis between the adjustable left and right exercise starting positions and the forward-facing exercise finishing position, an unstable user support platform pivotally mounted on the base for rotation in at least two opposite directions between a centered orientation and first and second tilted orientations about at least one second, non-vertical pivot axis;

a U-shaped base mounting bracket;

a rotational pivot assembly comprising a lower portion and an upper portion, the upper portion comprising a turntable and a mounting post; and a stop assembly between the base and the unstable user support platform configured to limit tilting of the unstable user support platform to a predetermined angular range between the centered orientation and each of the first and second tilted orientations, wherein the U-shaped base mounting bracket is secured to an upper surface of the turntable using the mounting post, and the upper portion of the pivot assembly is rotatably mounted to the lower portion of the pivot assembly, and the rotary torso exercise machine further comprises a selectorized weight stack assembly which resists rotation of the lower torso support away from the adjustable left or right exercise starting positions, and which biases the lower torso support toward the adjustable left or right exercise starting positions.

34. The rotary torso exercise machine of claim 33, further comprising a cable and pulley assembly associated with the selectorized weight stack assembly.

* * * * *